US011353179B2

(12) United States Patent
Haraguchi

(10) Patent No.: US 11,353,179 B2
(45) Date of Patent: Jun. 7, 2022

(54) METHOD OF CONSTRUCTING BUILDING AND METHOD OF MOUNTING LARGE LIGHTWEIGHT LIGHTING FIXTURE IN BUILDING

(71) Applicant: NICHIA CORPORATION, Anan (JP)

(72) Inventor: Kei Haraguchi, Itano-gun (JP)

(73) Assignee: NICHIA CORPORATION, Anan (JP)

( * ) Notice: Subject to any disclaimer, the term of this patent is extended or adjusted under 35 U.S.C. 154(b) by 0 days.

(21) Appl. No.: 17/264,616

(22) PCT Filed: Aug. 2, 2019

(86) PCT No.: PCT/JP2019/030526
§ 371 (c)(1),
(2) Date: Jan. 29, 2021

(87) PCT Pub. No.: WO2020/027327
PCT Pub. Date: Feb. 6, 2020

(65) Prior Publication Data

US 2021/0293393 A1 Sep. 23, 2021

(30) Foreign Application Priority Data

Aug. 3, 2018 (JP) ..... JP2018-147256

(51) Int. Cl.
*F21S 8/02* (2006.01)
*E04B 9/18* (2006.01)
(Continued)

(52) U.S. Cl.
CPC ..... *F21S 8/026* (2013.01); *E04B 9/18* (2013.01); *F21S 8/04* (2013.01); *F21V 21/03* (2013.01);
(Continued)

(58) Field of Classification Search
CPC ..... F21S 8/026; F21S 8/04; E04B 9/18
See application file for complete search history.

(56) References Cited

U.S. PATENT DOCUMENTS 5,581,448 A * 12/1996 Harwood ..... F21V 23/06 362/147
8,454,204 B1 * 6/2013 Chang ..... F21V 7/041 362/257
(Continued)

FOREIGN PATENT DOCUMENTS

JP H08-124411 A 5/1996
JP 2006-070561 A 3/2006
(Continued)

*Primary Examiner* — Zheng Song
(74) *Attorney, Agent, or Firm* — Foley & Lardner LLP

(57) ABSTRACT

A method of installing a large lightweight lighting fixture includes: providing connector-terminated wiring in a space above a ceiling, the connector-terminated wiring being electrically connecting to the large lightweight lighting fixture, the ceiling comprising a ceiling material, the lighting fixture mounted to the ceiling without being fixed by a suspension member; connecting the connector-terminated wiring and a power supply adapter by using a connector of the connector-terminated wiring via an opening provided in the ceiling material; electrically connecting the lighting fixture and the power supply adapter while the lighting fixture is located in a room space below the formed ceiling; and mounting the lighting fixture to the ceiling material by passing a fastener through the opening of the ceiling material, wherein the fastener is included in (i) the lighting fixture, or (ii) the power supply adapter.

25 Claims, 15 Drawing Sheets

(51) Int. Cl.

| | |
|---|---|
| ***F21S 8/04*** | (2006.01) |
| ***F21V 21/03*** | (2006.01) |
| ***F21V 21/04*** | (2006.01) |
| ***F21V 23/00*** | (2015.01) |
| *F21Y 105/16* | (2016.01) |
| *F21Y 115/10* | (2016.01) |

(52) U.S. Cl.
CPC ..... *F21V 21/041* (2013.01); *F21V 23/009* (2013.01); *F21Y 2105/16* (2016.08); *F21Y 2115/10* (2016.08)

(56) References Cited

U.S. PATENT DOCUMENTS

| | | | | |
|---|---|---|---|---|
| 9,657,927 | B1 * | 5/2017 | Lanham | F21V 23/023 |
| 2002/0191405 | A1 * | 12/2002 | Sieczkowski | F21S 8/04 362/404 |
| 2008/0170398 | A1 | 7/2008 | Kim | |
| 2008/0232116 | A1 * | 9/2008 | Kim | F21V 21/03 362/365 |
| 2010/0142202 | A1 * | 6/2010 | Sugishita | F21V 7/0083 362/235 |
| 2011/0175533 | A1 * | 7/2011 | Holman | F21S 2/00 362/147 |
| 2013/0182416 | A1 * | 7/2013 | Wilson | F21V 23/06 362/147 |
| 2016/0040839 | A1 * | 2/2016 | Driscoll | F21V 29/767 362/294 |
| 2016/0312987 | A1 * | 10/2016 | Danesh | F21S 8/024 |
| 2016/0320007 | A1 * | 11/2016 | Araki | F21V 19/004 |
| 2017/0363263 | A1 * | 12/2017 | Ticktin | F21S 8/04 |

FOREIGN PATENT DOCUMENTS

| | | | |
|---|---|---|---|
| JP | 2007-080529 | A | 3/2007 |
| JP | 2012-248376 | A | 12/2012 |
| JP | 2013-134956 | A | 7/2013 |
| JP | 2014-135151 | A | 7/2014 |
| JP | 2014-222586 | A | 11/2014 |
| JP | 2017-027871 | A | 2/2017 |
| JP | 2017-095979 | A | 6/2017 |

* cited by examiner

METHOD OF CONSTRUCTING BUILDING AND METHOD OF MOUNTING LARGE LIGHTWEIGHT LIGHTING FIXTURE IN BUILDING

CROSS REFERENCE TO RELATED APPLICATIONS

This is a National Stage Application of PCT Application No. PCT/JP2019/030526, filed Aug. 2, 2019, which claims priority to Japanese Patent Application No. 2018-147256, filed on Aug. 3, 2018.

TECHNICAL FIELD

The invention relates to a method of constructing a building and a method of mounting a large lightweight lighting fixture in a building.

BACKGROUND ART

Lighting is an indispensable element not only in office buildings, plants, and commercial facilities but also in nearly all buildings. Also, in many countries, it is necessary to satisfy certain standards when constructing a building. For example, Japan has the Building Standards Act, the Fire Service Act, etc.; rules that are to be complied with are established. If the standards are not satisfied, the building is in violation, and the use of the building is restricted.

When constructing a building, the flow of the work proceeds from foundation work through framework construction, finishing work, and equipment installation. The installation of electrical equipment such as lighting and the like, plumbing equipment, etc., are performed after the framework is completed. Patent Literature 1 discusses a ceiling-mounted equipment support device such that work can be rapidly and easily performed when mounting ceiling-mounted equipment such as lighting, etc., to the ceiling side.

CITATION LIST

Patent Literature

[Patent Literature 1] Japanese Patent Application 2006-70561 (Kokai)

SUMMARY OF THE INVENTION

Technical Problem

However, the method discussed in Patent Literature 1 still requires considerable personnel and work man-hours. Therefore, it would be very beneficial to establish a system to more simply perform the mounting work of lighting when constructing a building, compared to conventional manners.

Solution to Problem

According to one embodiment, a method of constructing a building includes: providing connector-terminated wiring as wiring of a plurality of wiring located at a backward of a ceiling that electrically connects to a large lightweight lighting fixture, the large lightweight lighting fixture being a lighting fixture that is not fixed by a suspension member when being mounted to a ceiling; forming the ceiling by placing a plurality of ceiling materials; connecting the connector-terminated wiring and a power supply adapter by using a connector of the connector-terminated wiring via an opening provided in the ceiling material, the connector-terminated wiring being located in a ceiling backward space above the formed ceiling, the power supply adapter being located in a room space below the formed ceiling; electrically connecting the large lightweight lighting fixture and the power supply adapter; and mounting the large lightweight lighting fixture to the ceiling material by passing a fastener through the opening of the ceiling material, the fastener being included in the large lightweight lighting fixture electrically connected to the connector-terminated wiring, or the fastener being included in the power supply adapter electrically connected to the connector-terminated wiring.

According to one embodiment, a method of constructing a building includes: providing connector-terminated wiring as wiring of a plurality of wiring located at a backward of a ceiling, the connector-terminated wiring being electrically connecting to a large lightweight lighting fixture, the ceiling being formed by placing a plurality of ceiling materials, the large lightweight lighting fixture being a lighting fixture that is not fixed by a suspension member when being mounted to the ceiling; connecting the connector-terminated wiring and a power supply adapter by using a connector of the connector-terminated wiring via an opening provided in the ceiling material, the connector-terminated wiring being located in a ceiling backward space above the formed ceiling; electrically connecting the large lightweight lighting fixture and the power supply adapter, the large lightweight lighting fixture being prepared in a room space below the formed ceiling; and mounting the large lightweight lighting fixture to the ceiling material by passing a fastener through the opening of the ceiling material, the fastener being included in the large lightweight lighting fixture electrically connected to the connector-terminated wiring, or the fastener being included in the power supply adapter electrically connected to the connector-terminated wiring.

According to one embodiment, a method of constructing a building includes: providing connector-terminated wiring as wiring of a plurality of wiring located at a backward of a ceiling, the connector-terminated wiring being electrically connecting to a large lightweight lighting fixture, the ceiling being formed by placing a plurality of ceiling materials, the large lightweight lighting fixture being a lighting fixture that is not fixed by a suspension member when being mounted to the ceiling; connecting the connector-terminated wiring and a power supply adapter by using a connector of the connector-terminated wiring, and placing the power supply adapter electrically connected to the connector-terminated wiring in a ceiling backward space; electrically connecting the large lightweight lighting fixture and the power supply adapter; and mounting the large lightweight lighting fixture to the ceiling material by passing a fastener through an opening of the ceiling material, the fastener being included in the large lightweight lighting fixture electrically connected to the connector-terminated wiring.

According to one embodiment, a method of constructing a building includes: providing anti-shock-connection-device-terminated wiring as wiring of a plurality of wiring located at a backward of a ceiling, the connector-terminated wiring being electrically connecting to a large lightweight lighting fixture, the large lightweight lighting fixture being a lighting fixture that is not fixed by a suspension member when being mounted to a ceiling; forming the ceiling by placing a plurality of ceiling materials; connecting the anti-shock-connection-device-terminated wiring and a power supply adapter by using an anti-shock connection device of the anti-shock-connection-device-terminated wiring via an opening provided in the ceiling material, the anti-shock-connection-device-terminated wiring being located in a ceiling backward space above the formed ceiling, the power supply adapter being prepared in a room space below the formed ceiling; electrically connecting the large lightweight lighting fixture and the power supply adapter; and mounting the large lightweight lighting fixture to the ceiling material by passing a fastener through the opening of the ceiling material, the fastener being included in the large lightweight lighting fixture electrically connected to the anti-shock-connection-device-terminated wiring, or the fastener being included in the power supply adapter electrically connected to the anti-shock-connection-device-terminated wiring.

According to one embodiment, a method of constructing a building includes: providing anti-shock-connection-device-terminated wiring as wiring of a plurality of wiring located at a backward of a ceiling, the anti-shock-connection-device-terminated wiring being electrically connecting to a large lightweight lighting fixture, the ceiling being formed by placing a plurality of ceiling materials, the large lightweight lighting fixture being a lighting fixture that is not fixed by a suspension member when being mounted to the ceiling; connecting the anti-shock-connection-device-terminated wiring and a power supply adapter by using an anti-shock connection device of the anti-shock-connection-device-terminated wiring via an opening provided in the ceiling material, the anti-shock-connection-device-terminated wiring being located in a ceiling space above the formed ceiling; electrically connecting the large lightweight lighting fixture and the power supply adapter, the large lightweight lighting fixture being prepared in an room space below the formed ceiling; and mounting the large lightweight lighting fixture to the ceiling material by passing a fastener through the opening of the ceiling material, the fastener being included in the large lightweight lighting fixture electrically connected to the anti-shock-connection-device-terminated wiring, or the fastener being included in the power supply adapter electrically connected to the anti-shock-connection-device-terminated wiring.

According to one embodiment, a method of constructing a building includes: providing anti-shock-connection-device-terminated wiring as wiring of a plurality of wiring located at a backward of a ceiling of a ceiling for electrically connecting to a large lightweight lighting fixture, the ceiling being formed by placing a plurality of ceiling materials, the large lightweight lighting fixture being a lighting fixture that is not fixed by a suspension member when being mounted to the ceiling; connecting the anti-shock-connection-device-terminated wiring and a power supply adapter by using an anti-shock connection device of the anti-shock-connection-device-terminated wiring, and placing, in a ceiling backward space, the power supply adapter electrically connected to the anti-shock-connection-device-terminated wiring; electrically connecting the large lightweight lighting fixture and the power supply adapter; and mounting the large lightweight lighting fixture to the ceiling material by passing, through an opening of the ceiling material, a fastener included in the large lightweight lighting fixture electrically connected to the anti-shock-connection-device-terminated wiring.

According to one embodiment, a method of constructing a building includes: work performed by a person having a qualification of a licensed electrician, the work including providing connector-terminated wiring as wiring of a plurality of wiring located at a backward of a ceiling, the connector-terminated wiring being electrically connecting to a large lightweight lighting fixture, the large lightweight lighting fixture being a lighting fixture that is not fixed by a suspension member when being mounted to a ceiling; and work performable by a person not having a qualification of a licensed electrician, the work including forming the ceiling by placing a plurality of ceiling materials, connecting the connector-terminated wiring and a power supply adapter by using a connector of the connector-terminated wiring via an opening provided in the ceiling material, the connector-terminated wiring being located in a ceiling backward space above the formed ceiling, the power supply adapter being prepared in an room space below the formed ceiling, electrically connecting the large lightweight lighting fixture and the power supply adapter, and mounting the large lightweight lighting fixture to the ceiling material by passing a fastener through the opening of the ceiling material, the fastener being included in the large lightweight lighting fixture electrically connected to the connector-terminated wiring or in the power supply adapter electrically connected to the connector-terminated wiring, the connecting by using the connector of the connector-terminated wiring being performed after the providing of the connector-terminated wiring.

According to one embodiment, a method of constructing a building includes work performed by a person having a qualification of a licensed electrician, the work including; work performed by a person having a qualification of a licensed electrician, the work including providing connector-terminated wiring as wiring of a plurality of wiring located at backward of a ceiling of a ceiling for electrically connecting to a large lightweight lighting fixture, the ceiling being formed by placing a plurality of ceiling materials, the large lightweight lighting fixture being a lighting fixture that is not fixed by a suspension member when being mounted to the ceiling; and work performable by a person not having a qualification of a licensed electrician, the work including connecting the connector-terminated wiring and a power supply adapter by using a connector of the connector-terminated wiring via an opening provided in the ceiling material, the connector-terminated wiring being located in a ceiling backward space above the formed ceiling, electrically connecting the large lightweight lighting fixture and the power supply adapter, the large lightweight lighting fixture being prepared in an room space below the formed ceiling, and mounting the large lightweight lighting fixture to the ceiling material by passing a fastener through the opening of the ceiling material, the fastener being included in the large lightweight lighting fixture electrically connected to the connector-terminated wiring, or the fastener being included in the power supply adapter electrically connected to the connector-terminated wiring, the connecting by using the connector of the connector-terminated wiring being performed after the providing of the connector-terminated wiring.

According to one embodiment, a method of constructing a building includes: work performed by a person having a qualification of a licensed electrician, the work including providing connector-terminated wiring as wiring of a plurality of wiring located at a backward of a ceiling of a ceiling for electrically connecting to a large lightweight lighting fixture, the ceiling being formed by placing a plurality of ceiling materials, the large lightweight lighting fixture being a lighting fixture that is not fixed by a suspension member when being mounted to the ceiling; and work performable by a person not having a qualification of a licensed electrician, the work including connecting the connector-terminated wiring and a power supply adapter by using a connector of the connector-terminated wiring, and placing, in a ceiling space, the power supply adapter electrically connected to the connector-terminated wiring, electrically connecting the large lightweight lighting fixture and the power supply adapter, and mounting the large lightweight lighting fixture to the ceiling material by passing a fastener through an opening of the ceiling material, the fastener being included in the large lightweight lighting fixture electrically connected to the connector-terminated wiring, the connecting by using the connector of the connector-terminated wiring being performed after the providing of the connector-terminated wiring.

According to one embodiment, a method of mounting a large lightweight lighting fixture in a building when constructing the building, the mounting being performed after providing a plurality of wiring located at a backward of a ceiling and after forming a ceiling by fixing a plurality of ceiling materials with a suspension member, the large lightweight lighting fixture being a lighting fixture that is not fixed by a suspension member when being mounted to the ceiling, the method comprising: connecting connector-terminated wiring and a power supply adapter by using a connector of the connector-terminated wiring via an opening provided in the ceiling material, the connector-terminated wiring being provided as wiring of a plurality of wiring located in a ceiling backward space above the formed ceiling for electrically connecting to the large lightweight lighting fixture, the power supply adapter being prepared in an room space below the formed ceiling; electrically connecting the large lightweight lighting fixture and the power supply adapter; and mounting the large lightweight lighting fixture to the ceiling material by passing a fastener through the opening of the ceiling material, the fastener being included in the large lightweight lighting fixture electrically connected to the connector-terminated wiring, or the fastener being included in the power supply adapter electrically connected to the connector-terminated wiring.

Effect of Invention

According to the invention, a building can be constructed by more simply performing the mounting work of lighting compared to conventional manner.

DESCRIPTION OF EMBODIMENTS

Figure 1:
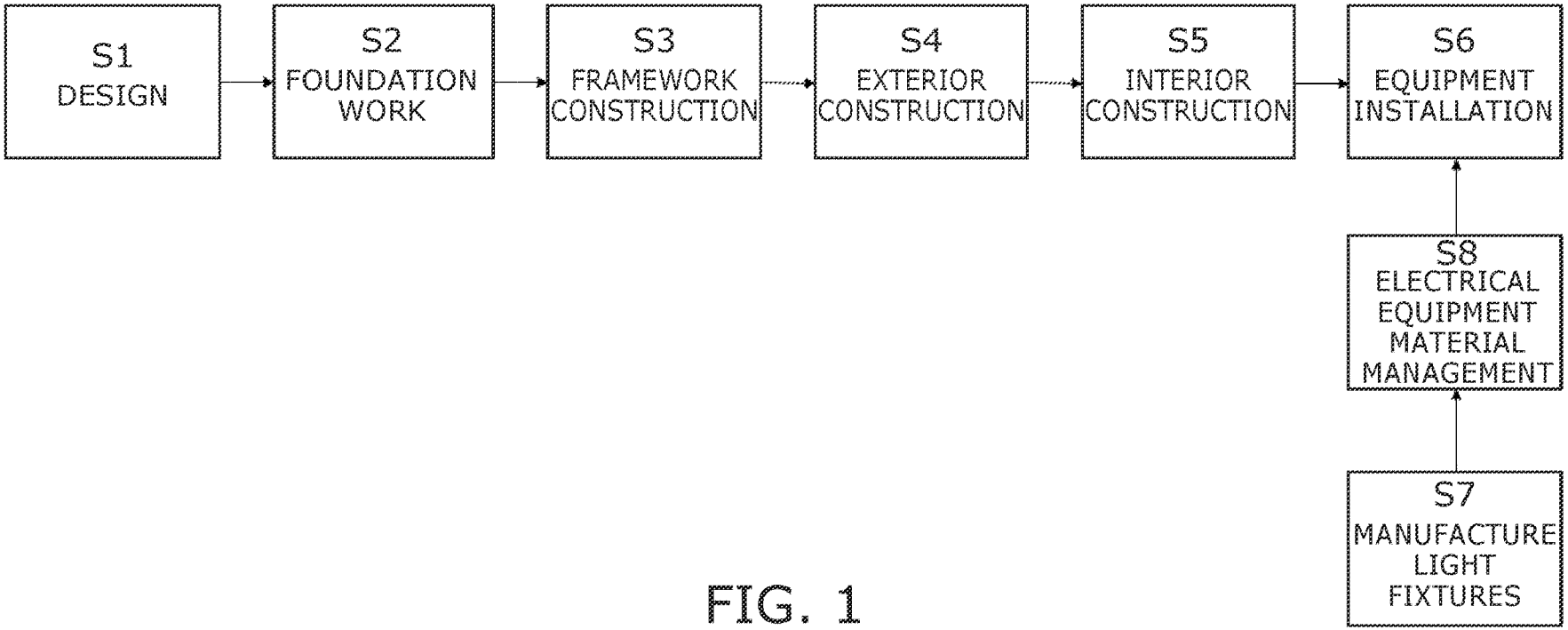
FIG. 1 is a flowchart for describing a flow of lighting installation in processes of constructing a building.

Embodiments for carrying out the invention are described below with reference to the drawings. However, the embodiments shown below embody the technical idea of the invention and do not limit the invention. Also, in the following description, the same names and reference numerals refer to the same or similar members, and a detailed description is omitted as appropriate. There are cases where the sizes, positional relationships, and the like of the members shown in the drawings are exaggerated to clarify the description.

FIG. 1 is a flowchart for describing the flow of lighting installation in the processes of constructing a building. Here, the building that is considered includes passageways and rooms, and has a plural-story structure as in a general office building. When constructing a large-scale building such as an office building, a general contractor is contracted to order the construction work and performs the coordination of the entire construction work performed by various subcontractors.

First, an architect and/or designer design the building (step S1). In this process, the layout of the passageways and the rooms, etc., are determined, and the overall design of the building is recorded in design drawings. Also, the construction materials and the electrical equipment materials such as lighting fixtures, etc., that will be employed are somewhat determined; the locations of these materials also are described in the drawings.

Then, based on the determined design, the construction materials and the construction machinery are prepared, and the foundation work is performed (step S2). In this process, piling and/or earthwork are performed to ensure a stable foundation that can withstand the load of the building. Here, the work is mainly performed by workers of the subcontractor performing the civil engineering work. The work is not limited to the workers of a civil engineering contractor and is performed by workers of other subcontractors as well.

Then, framework construction is performed to form the framework of the building on the stable foundation (step S3). When a foundation part and/or basement floors exist, the framework construction starts from the underground construction of the basement floors, etc., and proceeds toward the above-ground floors. Pouring concrete, erecting columns, assembling the steel frame, etc., are performed, and the framework of the entire building is completed. Also, concrete is poured in the exterior walls, the rooftop, the floor of each story, etc., as well.

Also, in the framework construction, inserts for hanging hanger bolts in the subsequent interior construction are embedded. For example, the ceiling inserts for fixing the hanger bolts are fixed as a portion of the floor slab (the reinforced concrete floorboard, etc.) when pouring the slab of the story above. Here, the work is mainly performed by workers of the subcontractor performing the civil engineering work, workers of subcontractors performing scaffolding/earthwork/concreting, etc. Then, the exterior construction of the building is performed (step S4). Tiling of the exterior walls, window sashes, windowpanes, curtain walls, etc., are mounted. Also, painting, etc., are performed.

Then, interior construction is performed (step S5). The ceilings, the walls, and the floors are made in the interior construction. In the ceiling construction of installing the ceilings, hanger bolts are hung from the ceiling inserts provided in the framework construction of step S3; and ceiling materials, which are members forming the ceiling surfaces such as ceiling boards, ceiling backing materials, etc., are mounted to a foundation made by assembling lightweight steel frame materials. Suspension members such as hanger bolts, hangers, and the like, oblique members, etc., are used to support the ceiling materials; thereby, prevention measures against the danger of the ceiling boards falling are taken.

For example, in Japan, the Building Standards Act, enforcement orders, etc., provide regulations for the prevention of such ceiling collapse. One of these regulations for pre-performing fall prevention measures such as fixing with suspension members, etc., in order to provide ceiling materials that satisfy the established conditions. For lighting fixtures as well, according to the size, the weight, etc., some can be mounted to a ceiling without fixing by a suspension member, and some are fixed by suspension members.

Instead of installing the ceiling inserts for fixing the hanger bolts when pouring the concrete, it is also possible to fix the hanger bolts by driving anchors into the concrete after placement. However, considering efficiency and/or safety, it is preferable for the installation to be performed beforehand; for the locations of the suspension members that are known, it is desirable to determine the locations of the ceiling inserts in the design stage and to sink the ceiling inserts when pouring the concrete.

Also, in the interior construction, the work of pre-suspending piping and air conditioning ducts and passing power lines and the like through the piping also is performed before affixing the ceiling, that is, before completing the formation of the ceiling made of the ceiling materials. Therefore, space that is necessary for installing electrical wiring, ducts, air conditioners, or the like is provided at the backward of the ceiling. Furthermore, openings are provided in the ceiling materials to match the locations where lighting and/or air conditioning are mounted. Here, the work of installing ducts inside the ceiling and fixing the ceiling materials with the suspension members is performed by the workers of the subcontractor performing the interior construction, etc. On the other hand, due to the danger of electric shock, etc., an expert worker that is permitted to perform electrical work performs the work of providing the electrical wiring.

It is assumed, in many cases, that the worker of the ceiling construction of installing the ceiling is different to the worker of the wiring work of passing the electrical wiring through at the backward of the ceiling. In Japan, electrical work such as wiring work or the like is not permitted by a person not having the qualification of a licensed electrician. Thus, as a safety precaution in the construction of a building, workers are dispatched from various expert subcontractors, and the workers perform expert work.

In the present specification, a worker of a subcontractor that prepares ceiling materials and performs the ceiling construction for constructing a building is called a ceiling installer. Also, a worker of a subcontractor that prepares electrical wiring and performs the wiring work for constructing a building is called a wiring worker. Normally, the construction of each process of constructing a building is performed by multiple workers. Accordingly, the ceiling installer is not limited to one worker and refers to one or more workers performing the ceiling construction in the construction of a building. This is similar for the wiring worker, etc., as well.

Then, when the interior construction is finished and the floors, the walls, and the ceilings are completed, the installation work is performed (step S6). In the installation work, the equipment that is necessary when actually utilizing the building is installed. For example, the equipment for electricity, gas, service water, drainage, air conditioning, toilets, emergency, loudspeakers, etc., and the equipment of lighting, escalators, elevators, etc., are provided. This work is performed by workers of businesses of electrical work, telecommunication work, waterworks construction, fire-fighting facility construction, cleaning facility construction, etc.

In lighting installation work as well, because it is necessary to electrically connect lighting fixtures, work by a person qualified as a licensed electrician is necessary. Although the mounting locations of lighting are not limited to a ceiling, normally, the lighting fixtures that are mounted to the ceiling are electrically connected by being connected to wiring prepared at the backward of the ceiling by a person qualified as a licensed electrician. When air conditioners are mounted to the ceiling in the equipment installation of air conditioning as well, the connection is made to wiring prepared at the backward of the ceiling by a person qualified as a licensed electrician.

Normally, in a room of a building such as an office building, large lighting fixtures and/or air conditioners that are located in the ceiling are fixed by suspension members. Accordingly, a worker that performs the installation work of such large lighting fixtures and/or air conditioners also performs the work of mounting the large lighting fixtures and/or air conditioners to the ceiling by fixing to the suspension members hanging from the ceiling inserts.

To be in time for the lighting installation work, the manufacturer of the lighting fixtures manufactures the lighting fixtures necessary for the construction and delivers the lighting fixtures to an electrical material trading company that manages the electrical equipment materials (step S7). Also, the electrical material trading company manages the inventory of not only lighting fixtures but also materials such as switches, plug sockets, power lines, cables, distribution boards, antennae, and the like, materials such as circuit breaker panels, interphones, fire alarms, etc., and supplies only the necessary amount of the electrical equipment materials that is necessary for the construction (step S8). In the present specification, the employee of a subcontractor that manufactures lighting fixtures or delivers lighting fixtures is called a lighting fixture supplier.

In the installation work process, the lighting installation work and the air conditioning installation work are separately performed. Although it is possible for the installation work to be simultaneously performed or for the same person to perform both of the installation work, the work is generally allotted to some workers in consideration of the work efficiency. Thus, the building is constructed.

When referring to a worker of the installation work in the present specification, this refers to one or more workers performing installation work of lighting, air conditioning, etc., and may include the same person performing the lighting and air conditioning installation work as described above. On the other hand, when referring to a worker of lighting installation work, this refers to one or more workers performing lighting installation work but not performing air conditioning installation work. When referring to a worker of air conditioning installation work, this refers to one or more workers performing air conditioning installation work but not performing lighting installation work.

First Embodiment

Figure 2:
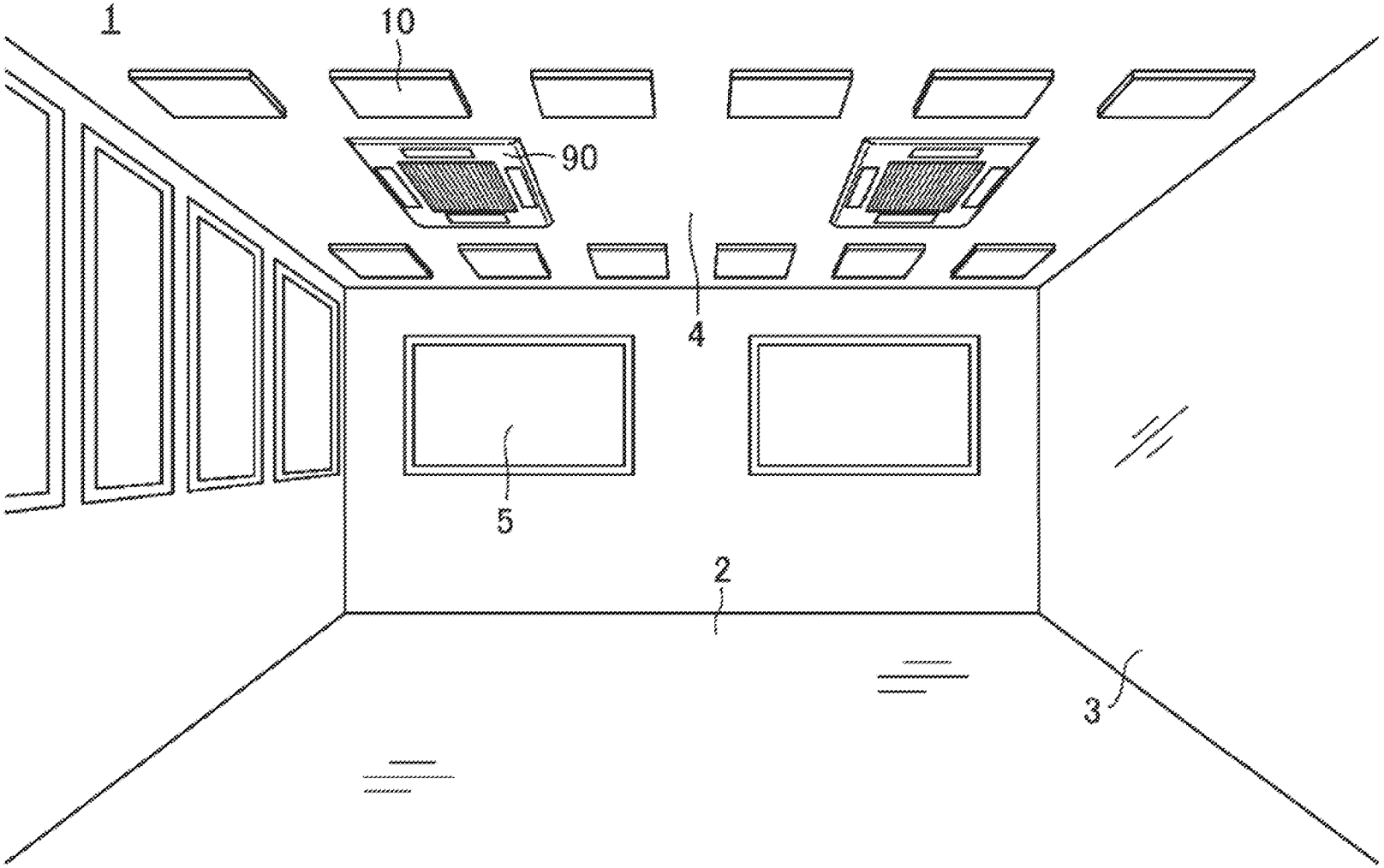
FIG. 2 is a schematic view illustrating an example of a structure of a room of the building according to the embodiment.

A construction process of a building according to a first embodiment will now be described. The building 1 according to the first embodiment includes a plural-story structure and includes passageways and rooms. The building 1 can be a one-story building. FIG. 2 is a schematic view illustrating an example of the structure of a room of a designated story of the building 1.

In the building 1, a room space is formed of a floor 2, walls 3, a ceiling 4, and windows 5. In the rooms, only the walls 3 exist but not the windows 5 on the lateral surfaces. Also, multiple lighting fixtures 10 and multiple air conditioners 90 are mounted to the ceiling. The air conditioners 90 can be one air conditioner 90.

Figure 3:
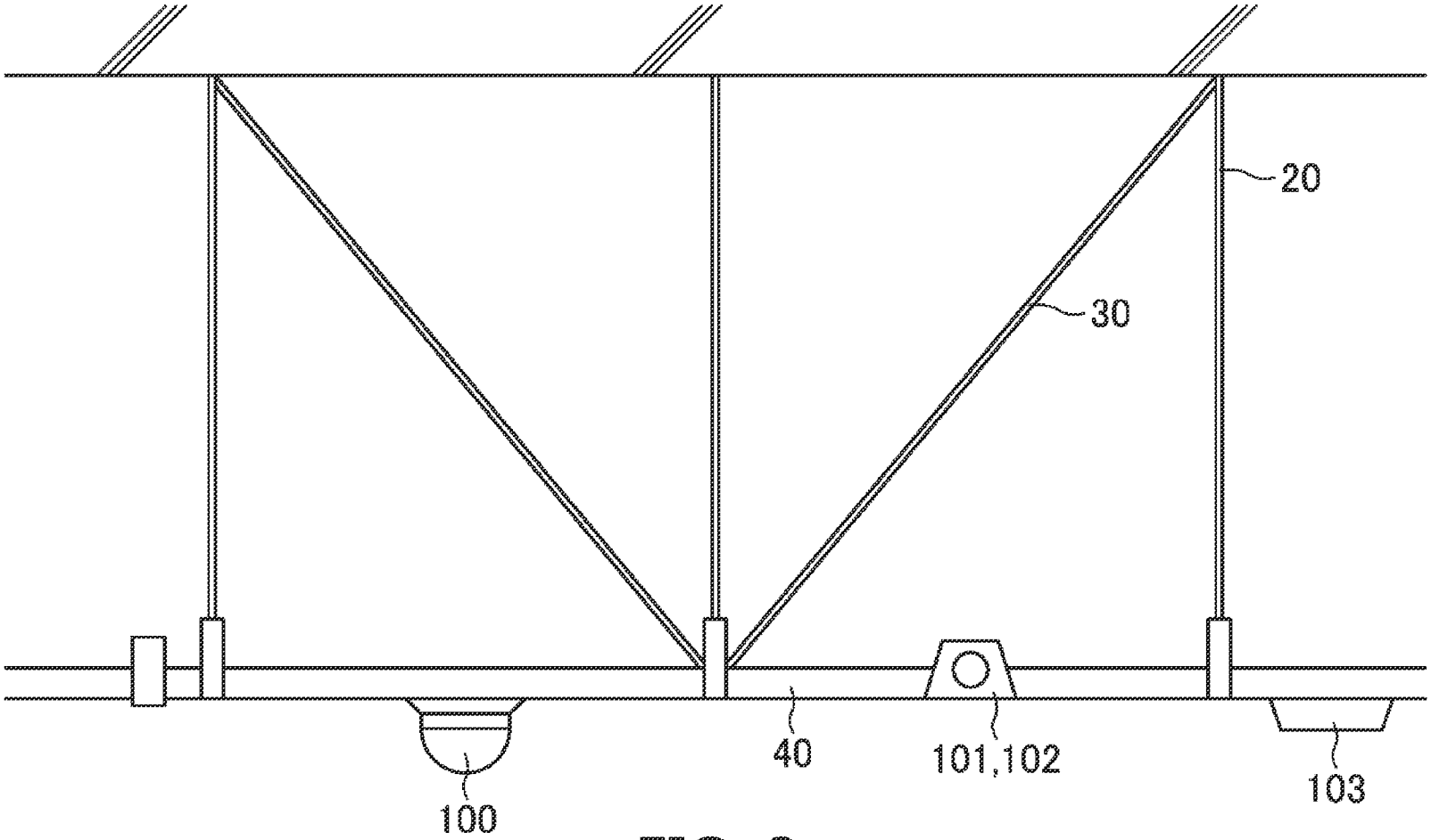
FIG. 3 is a figure showing an example of a ceiling-mounted appliance not fixed by a suspension member.

Here, before describing the lighting fixture 10 according to the invention, the difference of installation structures of various appliances mounted to the ceiling between when the various appliances are fixed by suspension members and when the various appliances are not fixed by suspension members will be described using FIGS. 3 and 4. FIG. 3 shows mounting examples of ceiling-mounted appliances for which fixation by suspension members is unnecessary, and FIG. 4 shows mounting examples of ceiling-mounted appliances for which fixation by suspension members is necessary.

As shown in FIG. 3, for example, small ceiling-mounted appliances such as a surveillance camera 100, a downlight 101, emergency lighting 102, a smoke detector sensor 103, etc., are mounted without being fixed by oblique members 30 and/or suspension members 20 such as hanger bolts, etc. It is permitted to mount such small ceiling-mounted appliances without requiring suspension members because the load applied to the ceiling materials is small.

Figure 4:
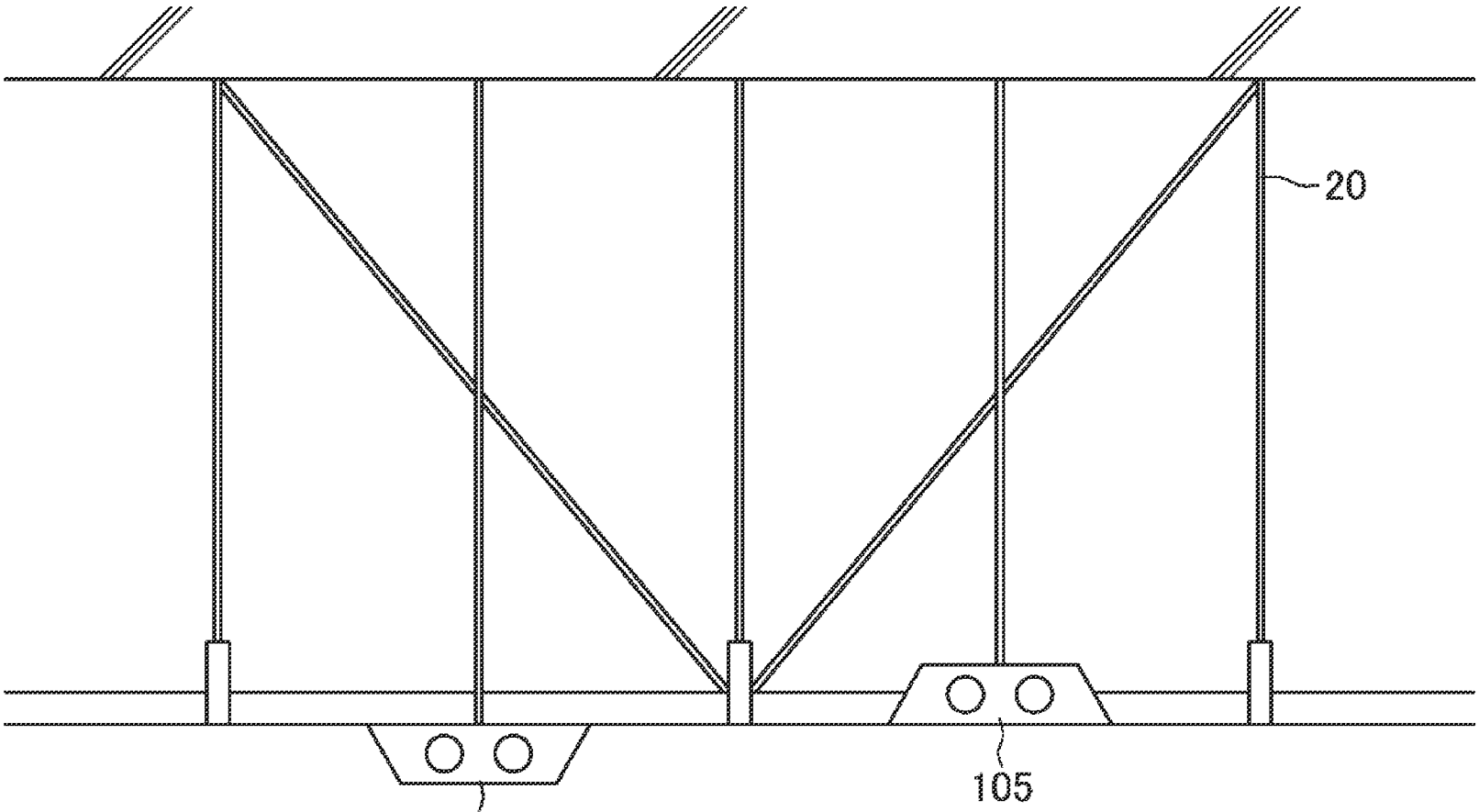
FIG. 4 is a figure showing an example of a ceiling-mounted appliance fixed by a suspension member.

On the other hand, as shown in FIG. 4, ceiling surface-mounted general lighting 104 that is mounted to the ceiling surface, embedded general lighting 105 that is mounted to pass through the ceiling material to appear from the room to be embedded, etc., are mounted by being fixed by the suspension members 20. Because the load that is applied to the ceiling material is large, the danger of falling, for example, when an earthquake occurs is high unless such ceiling-mounted appliances are fixed by suspension members. Accordingly, all of the load is not applied to the ceiling material in the installation structure, and the ceiling-mounted appliance itself is supported by the suspension member.

For example, it is considered that in a building such as an office building, small ceiling-mounted appliances such as a downlight 101, etc., are provided as lighting in narrow spaces such as passageways, etc.; large lighting fixtures such as the general lighting 104, the general lighting 105, etc., are provided in wide spaces such as rooms, etc. Based on the number of lighting fixtures mounted, although small lighting fixtures may be partially provided, a large majority of lighting fixtures mounted in the entire room are large lighting fixtures. Accordingly, when general lighting such as that shown in FIG. 4 is used, fixation work using suspension members is performed in the lighting installation work.

The lighting fixture 10 according to the present invention has a performance as a lighting fixture that is equivalent to the general lighting shown in FIG. 4 and realizes a lighting fixture for which fixation by a suspension member is unnecessary in the lighting installation work as shown in FIG. 3. That is, the lighting fixture 10 is a large lightweight lighting fixture that is lightweight enough not to require a suspension member, while being large enough to be treated as being equivalent to general lighting.

Here, a large lightweight lighting fixture in the present specification refers to a lighting fixture that satisfies at least one of: the total luminous flux being 2500 lm or more; the surface area of the light-emitting surface which is the surface closest to the floor being 45000 $mm^2$ or more; or 100 or more light source elements being provided. In addition to above conditions, the characteristics of the large lightweight lighting fixture can be further designated using the condition of the weight being not less than 0.5 kg but less than 2.5 kg.

Figure 5:
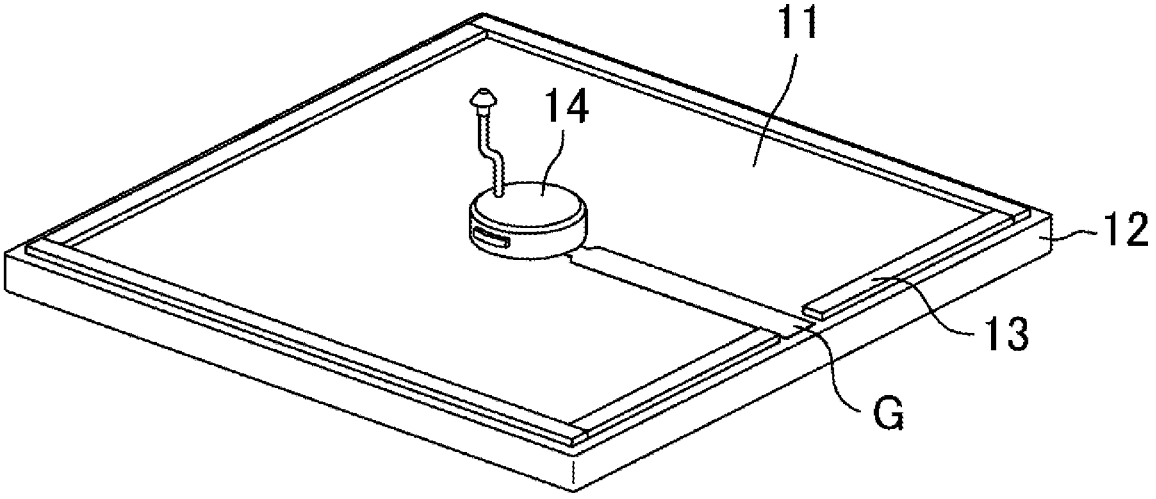
FIG. 5 is a perspective view of a lighting fixture according to the embodiment.
Figure 6:
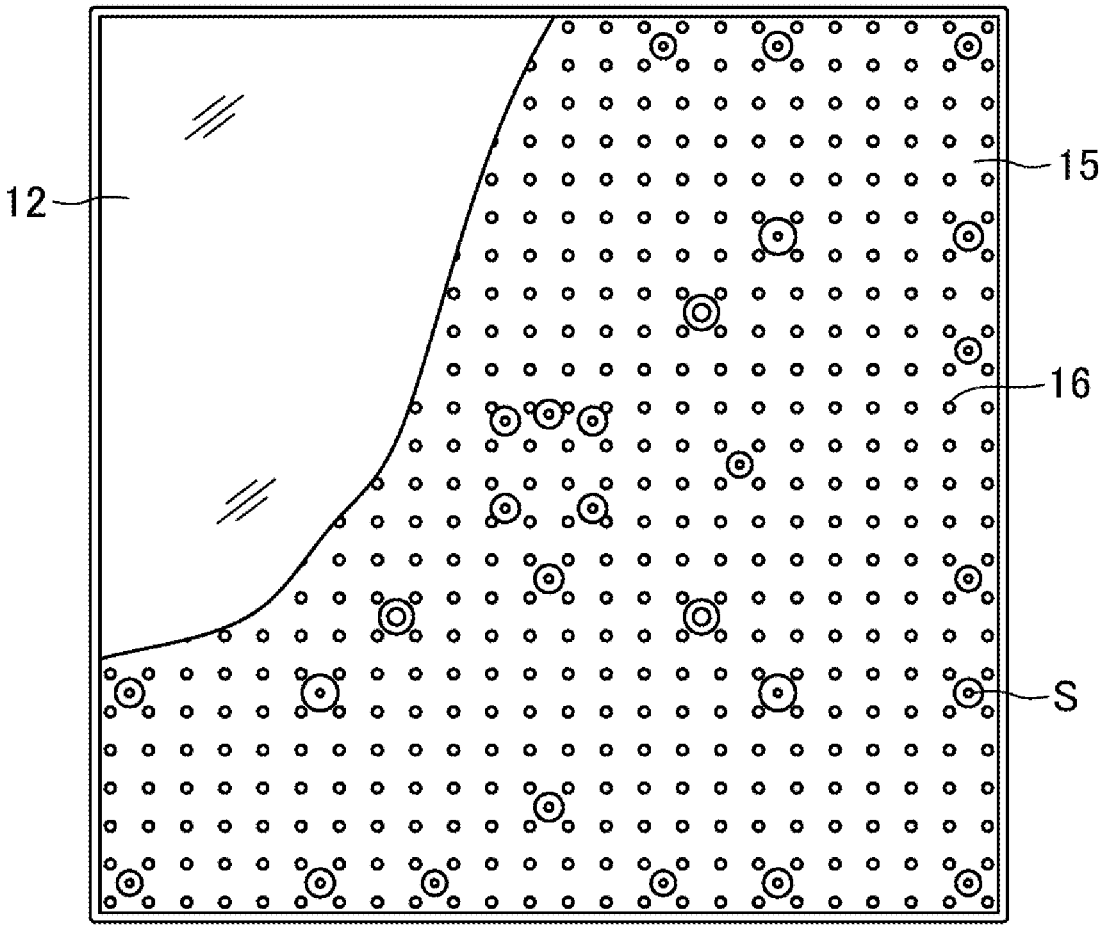
FIG. 6 is a schematic view for describing a light-emitting surface of the lighting fixture according to the embodiment.
Figure 7:
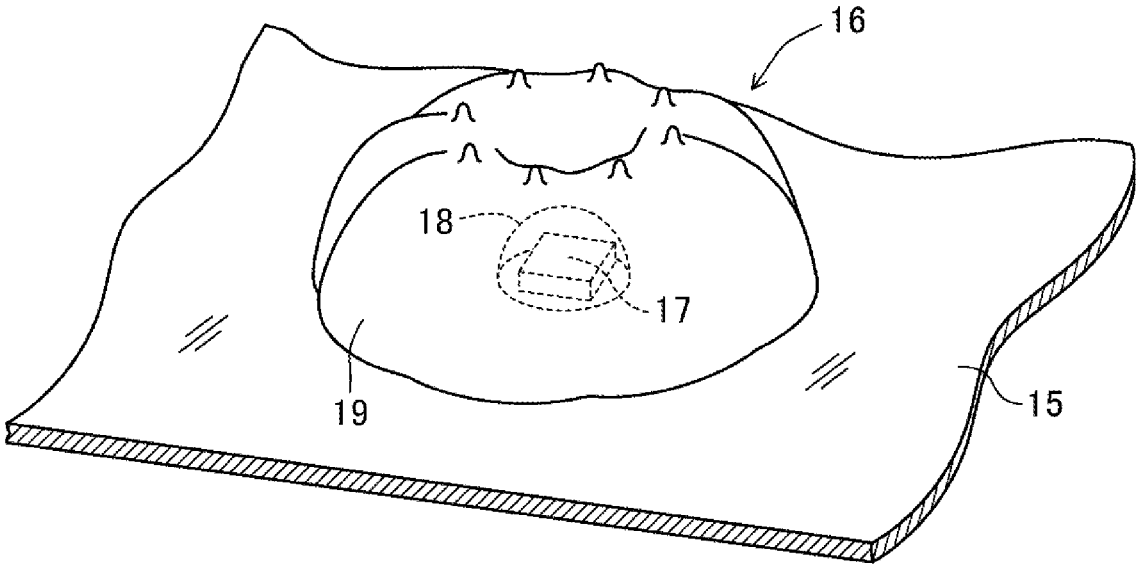
FIG. 7 is a perspective view showing a light source element in the lighting fixture according to the embodiment.

The lighting fixture 10, which is a large lightweight lighting fixture, will now be described. FIG. 5 is a perspective view of the lighting fixture 10 when viewed from the mounting surface side that is mounted to the ceiling. FIG. 6 is a schematic view for describing the light-emitting surface of the lighting fixture 10. FIG. 7 is a perspective view showing a light source element 16 used in the lighting fixture 10. The lighting fixture 10 described based on FIGS. 5 to 7 has 450 mm long and 450 mm wide, a height from the ceiling mounting surface to the light-emitting surface of 20 mm, and a square light-emitting surface.

The lighting fixture can be square shaped and have a light-emitting surface that is 600 mm×600 mm. Also, the lighting fixture can be rectangular shaped and have a light-emitting surface that is 150 mm×600 mm, or can be a rectangular lighting fixture that is 75 mm×600 mm. Also, the light-emitting surface can be polygonal, circular, or elliptical; the shape is not limited. Also, in the application, figures of which the four corners are beveled, etc., also are included and are called square or rectangular.

The lighting fixture 10 includes a base plate 11, a cover 12, a cushioning part 13, a mounting adapter 14, a substrate 15, and the light source element 16. The base plate 11 functions as a reinforcing plate or a heat dissipation plate of the lighting fixture 10. For example, the base plate 11 is a metal plate formed in a rectangular shape. For example, the metal plate can be formed using aluminum as a material.

In the present specification, "light source" refers to a member that emits light; a light source can be a light-emitting element typified by an LED, or can be a combination of a light-emitting element and a wavelength conversion member. "Wavelength conversion member" refers to a member that converts a portion or entirety of the light emitted by a light-emitting element into light of another wavelength; for example, a fluorescer member is an example.

The cover 12 is provided to cover the light source elements 16 disposed on the substrate 15. Also, the cover 12 is transmissive to the light emitted by the light source elements 16. For example, the cover 12 is formed to be light-diffusing milky white by dispersing titanium oxide or the like in a resin material. As the resin material, for example, an acrylic resin can be employed; for example, a polymethyl methacrylate resin can be employed.

The cushioning part 13 is provided at the outer perimeter of the ceiling mounting surface of the base plate 11. The cushioning part 13 prevents the ceiling mounting surface of the base plate 11 from directly contacting the ceiling 4 (or a ceiling material 40) and cushions impacts. Also, the cushioning part 13 is not provided at a portion of the outer perimeter of the base plate 11 and includes a detachment arm insertion slot G corresponding to the thickness of the cushioning part 13.

The mounting adapter 14 is fitted into a power supply adapter 60, which is described below. The power supply adapter 60 is mounted to the ceiling material 40, and the mounting adapter 14 is mounted to the ceiling 4 via the power supply adapter 60. Also, the mounting adapter 14 is connected to a DC harness 64 of the power supply adapter 60 and receives a supply of power from a DC power supply.

The substrate 15 is, for example, a resin or ceramic insulative substrate and includes a light source placement surface on which the multiple light source elements 16 are arranged. Also, a conductive pattern for supplying power to the light source elements 16 is provided at the light source placement surface of the substrate 15. The material of the conductive pattern can be selected as appropriate according to a major material of the substrate 15. For example, for a substrate formed of a ceramic material, the conductive pattern preferably has a high melting point to be able to withstand the firing temperature of a ceramic sheet. For example, the material of the conductive wiring can include a high-melting-point metal such as tungsten and/or molybdenum. Also, another metal material such as nickel, gold and/or silver, etc., can be provided as a covering member on the conductive wiring by plating, sputtering, vapor deposition, etc. Also, for a substrate formed of a resin material, the conductive pattern is preferably formed of a material to be easily patterned. For example, for a substrate formed of an injection molded resin, it is preferable for the conductive pattern to be easily patterned by punching, etching, bending, etc., while having a relatively high mechanical strength. Examples of specific materials of the conductive pattern include metals such as copper, aluminum, gold, silver, tungsten, rhodium, iron, nickel, molybdenum, and the like, an iron-nickel alloy, phosphor bronze, iron-containing copper, etc.

FIG. 6 shows the lighting fixture 10 in which the cover 12 is partially removed to see the structure inside the cover 12. In reality, the substrate 15 and the light source elements 16 of the lighting fixture 10 are covered with the cover 12. The surface on the side opposite to the light source placement surface of the substrate 15 is in contact with the base plate 11. Multiple screw holes S are provided in the substrate 15, and the substrate 15 is fastened to the base plate 11 by screws in the screw holes S.

The light source elements 16 are uniformly arranged at the substrate 15. The light source elements 16 are arranged at an interval not less than 15 mm and not more than to 20 mm at the light source placement surface, which has four 450 mm sides. As shown in FIG. 7, the light source element 16 includes a light-emitting element 17, a wavelength conversion member 18, and a encapsulant 19. The light-emitting element 17 is mounted to the light source placement surface of the substrate 15, and electrodes of the light-emitting element 17 are electrically connected to the conductive pattern formed at the substrate 15. The wavelength conversion member 18 covers the light-emitting element 17.

The encapsulant 19 can include a material that is electrically insulative, can transmit the light emitted from the light source (e.g., having a transmittance of 70% or more), and is fluidic before solidifying (e.g., before the curing is completed). For example, the encapsulant 19 can include a resin raw material; examples include a silicone resin, an epoxy resin, a phenol resin, a polycarbonate resin, an acrylic resin, a TPX resin, or a polynorbornene resin, a modified resin of these resins, a hybrid resin of these resins, etc. Among these, a silicone resin is preferable due to good heat resistance and/or light resistance (in the present specification, "silicone resin" refers to a "silicone-based resin" that comprehensively includes modified resins of silicone resins, a resin that has at least a silicone skeleton, etc.). Such an encapsulation raw material can additionally include a filler, a fluorescer, etc., as necessary.

The encapsulant 19 covers the wavelength conversion member 18. A portion of the encapsulant 19 that covers the central vicinity of the upper surface of the light-emitting element 17 has a recessed portion. Also, multiple projections are provided at a peripheral portion surrounding the recessed portion. The projections are substantially uniformly provided at the periphery of the recessed portion, and the recessed portion is within the region surrounded with straight lines connecting the adjacent projections. Thus, the light source element 16 has a batwing light distribution characteristic attributed to the encapsulant 19 that has a flattened shape as an entirety while having the recessed portion and the multiple projections.

Figure 8:
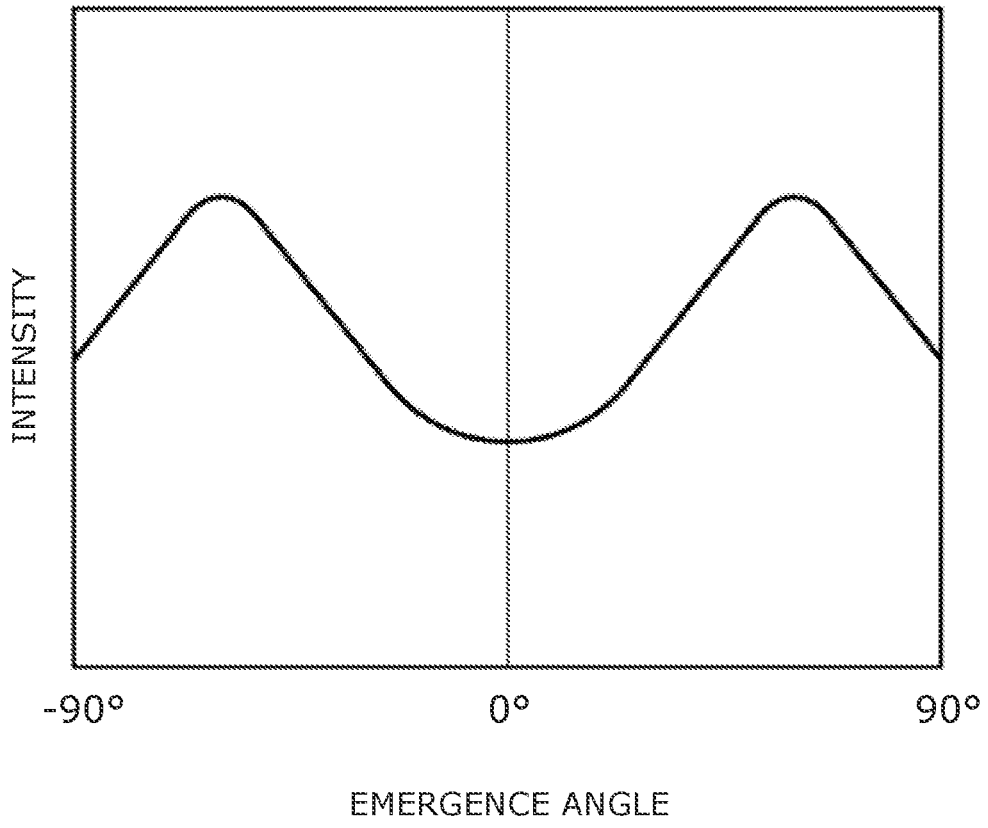
FIG. 8 is a figure showing an example of an optical characteristic of the light source element in the lighting fixture according to the embodiment.

FIG. 8 is a figure showing an example of the batwing light distribution characteristic. The horizontal axis is the exit angle of the light emitted from the light source element 16; a direction perpendicular to the light source placement surface at which the light source elements 16 are arranged is set to 0°. The vertical axis represents the intensity of the light emitted from the light source element 16. The batwing light distribution characteristic is a light distribution characteristic that has a first intensity peak that is greater than the intensity at the exit angle of 0° in the region in which the exit angle is in the range of 0° to −90°, and a second intensity peak that is greater than the intensity at the exit angle of 0° in the region in which the exit angle is in the range of 0° to 90°.

To obtain a preferable batwing alignment characteristic, the size of the projections are preferably not too large. For example, for the encapsulant 19, it is preferable to satisfy $0<h\leq H/8$, more preferable to satisfy $0<h\leq H/10$, and more preferable to satisfy $0<h\leq H/2$, where "h" is the height of the projection itself, and "H" is the height of the protrusion (the height of the encapsulant excluding the projections).

Also, at least the maximum thickness dimension of the encapsulant 19 is less than the maximum width dimension. For example, the maximum width is not less than 2 times the maximum thickness. It is preferable for the maximum thickness to be the height from the substrate 15 to the summit of the projection of the encapsulant 19. By virtue of such a flattened-shaped encapsulant, a batwing light emission is obtained with a lower height. Also, a defect in which the light source element 16 is undesirably detached from the substrate by an incidental external force can be suppressed.

As an example of such a lighting fixture 10 that is 450 mm×450 mm and has a height from the ceiling mounting surface to the light-emitting surface of 20 mm, a lighting fixture in which 24 longitudinal×24 lateral light source elements 16 for a total of 576 light source elements 16 were arranged had a total luminous flux of 4500 lm, a color temperature of 5000 K, and a weight of 1.94 kg. That is, the lighting fixture 10 of the example is an example of a large lightweight lighting fixture that satisfies at least one of the total luminous flux being 4000 lm or more, the surface area of the light-emitting surface which is the surface closest to the floor being 202500 $mm^2$ or more, 500 or more light source elements being provided, or the weight being less than 2.0 kg.

Also, as another example of the lighting fixture 10 that is different in that the light-emitting surface is 150 mm×600 mm, a lighting fixture in which 8×32 light source elements 16 for a total of 256 light source elements 16 were arranged had a total luminous flux of 3450 lm, a color temperature of 2700 K, and a weight of 1.09 kg. That is, the lighting fixture 10 of the other example is an example of a large lightweight lighting fixture that satisfies at least one of the total luminous flux being 3000 lm or more, the surface area of the light-emitting surface which is the surface closest to the floor being 90000 $mm^2$ or more, 200 or more light source elements being provided, or the weight being less than 1.5 kg.

The processes until the lighting fixture 10 is installed in the construction of the building 1 according to the present application will now be described. The differences from the processes until the building is constructed already described utilizing FIG. 1 will be described in detail, and descriptions of duplicate points are simple or omitted.

Because the lighting fixture 10 is not needed to be fixed by the suspension member 20, the architect and/or the designer does not need to predetermine the arrangement positions of the suspension members to match the mounting positions of the lighting fixtures 10 in step S1. Also, when the arrangement position of the general lighting 104 of FIG. 4 is changed after the ceiling insert is provided and the arrangement position of the suspension member 20 is determined, it is necessary to newly install a hanger bolt; on the other hand, this is unnecessary in the case of the lighting fixture 10. Accordingly, the architect and/or the designer can flexibly change the mounting locations of the lighting fixtures 10 even after the construction has somewhat progressed.

Figure 9:
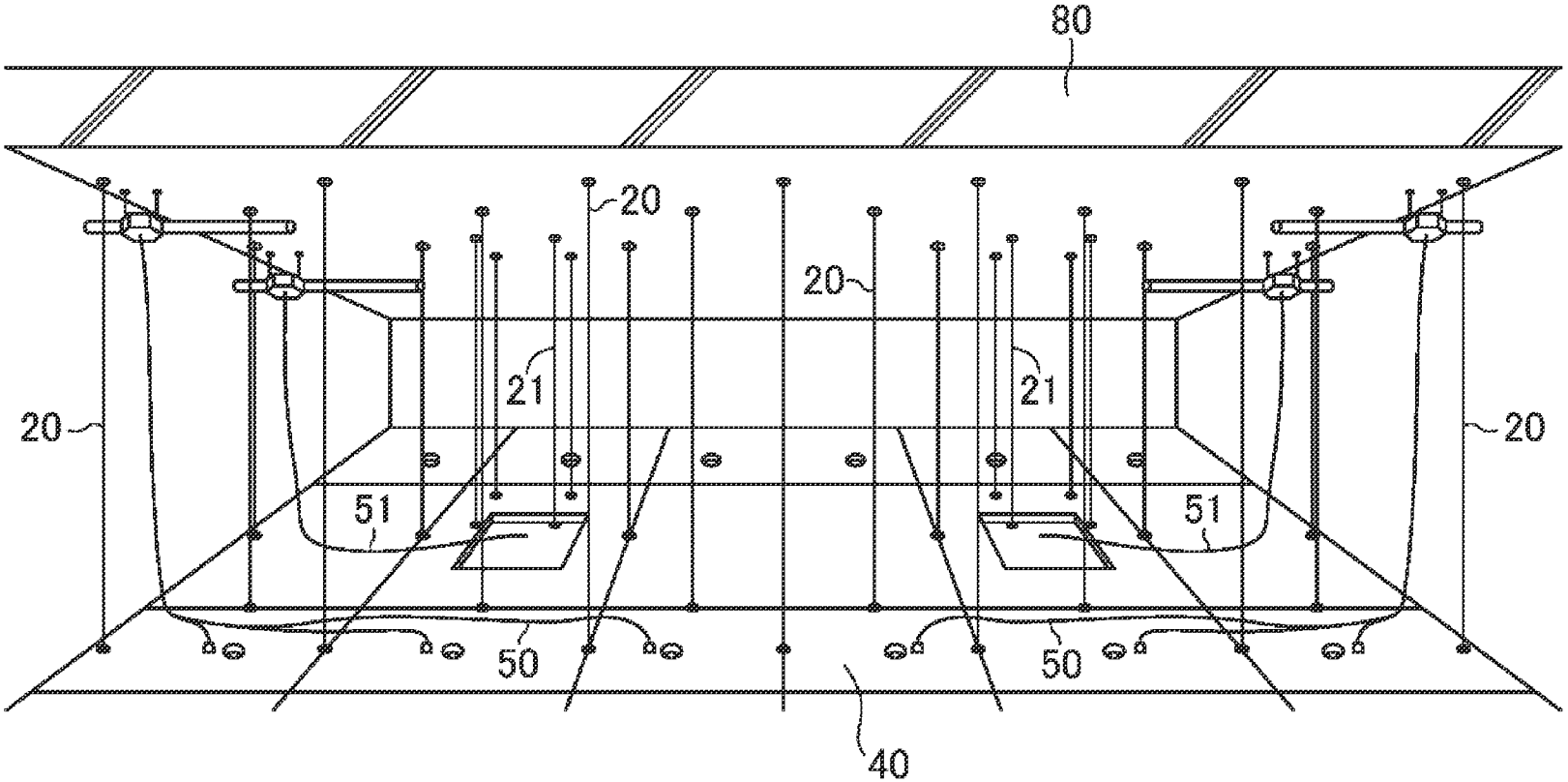
FIG. 9 shows a structure of backward of a ceiling in constructing the building according to the embodiment.

The processes from step S2 to step S4 are substantially similar to those already described. Then, the ceiling construction of providing the ceiling is performed in the interior construction of step S5. Also, before affixing the ceiling, the wiring that is located at the backward of the ceiling is passed through a position that is higher than the ceiling. FIG. 9 shows an example of the backward of the ceiling in the state in which the ceiling construction has been performed.

As in FIG. 9, the backward of the ceiling includes a space having an upper surface and lateral surfaces configured as a framework 80 where the concrete is placed and having a lower surface configured as the ceiling 4 formed by placing the ceiling materials 40. Also, each ceiling material 40 configured as the ceiling 4 is fixed and supported by the suspension members 20 linked to the ceiling inserts of the framework. A portion of the suspension members 20 are not illustrated in FIG. 9 to avoid the complexity of the drawing. Wiring 50 and wiring 51 that are provided by being passed through piping are in the space at the backward of the ceiling. The wiring is provided based on the design drawings according to the number of electrically connected equipment such as lighting, air conditioning, etc., that are to be mounted to the backward of the ceiling. The ceiling 4 is provided after preparing a sufficient number of wiring for the power supply to the electrically connected equipment.

Here, the work of passing the wiring through at the backward of the ceiling is performed by a wiring worker having the qualification of a licensed electrician. Also, in such work, a connector is provided, by a wiring worker having the qualification of a licensed electrician, for the wiring 50 to which the lighting fixture 10 is to be connected. The connector is an example of an anti-shock connection device for preventing an electric shock in the connection work performed for electrically connecting the electrically connected equipment, to connect between the electrically connected equipment and the wiring 50.

If an anti-shock connection device such as a connector or the like exists, the work of connecting the wiring 50 to the lighting fixture 10 can be performed by a person that does not have the qualification of a licensed electrician. In the example of FIG. 9, a connector is provided for the wiring 50 to which the lighting fixture 10 is to be connected, but an anti-shock connection device such as a connector or the like is not provided for the wiring 51 which is to be connected to the air conditioner 90. Accordingly, at the time of filing the present application, compliance with the laws and regulations of Japan requires that the work of connecting the wiring 51 to the air conditioner 90 is performed by a person having the qualification of a licensed electrician. A portion of the wiring 50 is not illustrated in FIG. 9 to avoid complexity of the drawing.

Also, because the air conditioner 90 is fixed by the suspension member 20, a suspension member 21 is provided as the suspension member 20 for fixing the air conditioner 90. At the timing of FIG. 9, the air conditioner 90 is not fixed by the suspension member 21 because the air conditioner 90 has not yet been mounted.

Openings for mounting ceiling-mounted appliances such as the air conditioner 90, the lighting fixture 10, etc., are provided in the ceiling material 40. The rectangular openings shown in FIG. 9 are openings for the air conditioners 90. Also, the circular openings are openings for the lighting fixtures 10. In the example of FIG. 9, among the 6×3 ceiling materials 40 for a total of eighteen ceiling materials 40, openings for mounting the air conditioners 90 are provided respectively in two ceiling materials 40, and openings for mounting the lighting fixtures 10 are provided respectively in twelve ceiling materials 40.

As shown in FIG. 9, the opening that is provided for mounting the lighting fixture 10 is small compared to the ceiling material 40. Also, the opening is sufficiently small compared to the light-emitting surface of the lighting fixture 10. For this aspect, conversely, the downlight 101 and the emergency lighting 102 shown in FIG. 3 have openings that are equal to the sizes of the lighting fixtures. In the present specification, the opening being not more than ⅓ of the surface area of the light-emitting surface is expressed as "sufficiently small". Also, the opening being not more than ⅕ of the surface area of the light-emitting surface is expressed as "extremely small". Also, the opening being not more than 1/10 of the surface area of the light-emitting surface is expressed as "exceedingly small".

For example, the opening for mounting the lighting fixture 10 is formed to be circular with a diameter of 10 cm to 15 cm. Also, the shape of the opening may not be circular, and the opening can be polygonal with a maximum diameter of 15 cm or less. Also, it is sufficient for these to be determined based on the size and/or shape of the power supply adapter 60, etc. Although described below, it is preferable to ensure that the opening is large enough for the arm of the worker to pass through so that the wiring 50 can be grasped by hand from the room side to mount the lighting fixture 10.

As one specific example of an opening, a circular opening with a diameter of 15 cm is provided for mounting a lighting fixture 10 that is 450 mm×450 mm and has a height from the ceiling mounting surface to the light-emitting surface of 20 mm. Accordingly, the lighting fixture 10 can be mounted with an exceedingly small opening. Also, as another example, a circular opening of 12.5 cm is provided for mounting a lighting fixture 10 that is 150 mm×600 mm and has a height from the ceiling mounting surface to the light-emitting surface of 20 mm. Accordingly, the lighting fixture 10 can be mounted with an extremely small opening.

The openings do not need to be provided beforehand in the ceiling material 40. Generally, the ceiling materials 40 with no opening is prepared, and then a worker makes holes in the ceiling material 40 at the workplace where the interior construction is performed. It is sufficient to perform the work of providing openings as appropriate in the ceiling materials 40 with no opening. The shapes of the openings to be prepared can be different according to the ceiling-mounted appliances to be mounted. Therefore, the openings can be provided when mounting the ceiling materials 40 to the ceiling by fixing with the suspension members 20, or can be provided after forming the ceiling.

Figure 10:
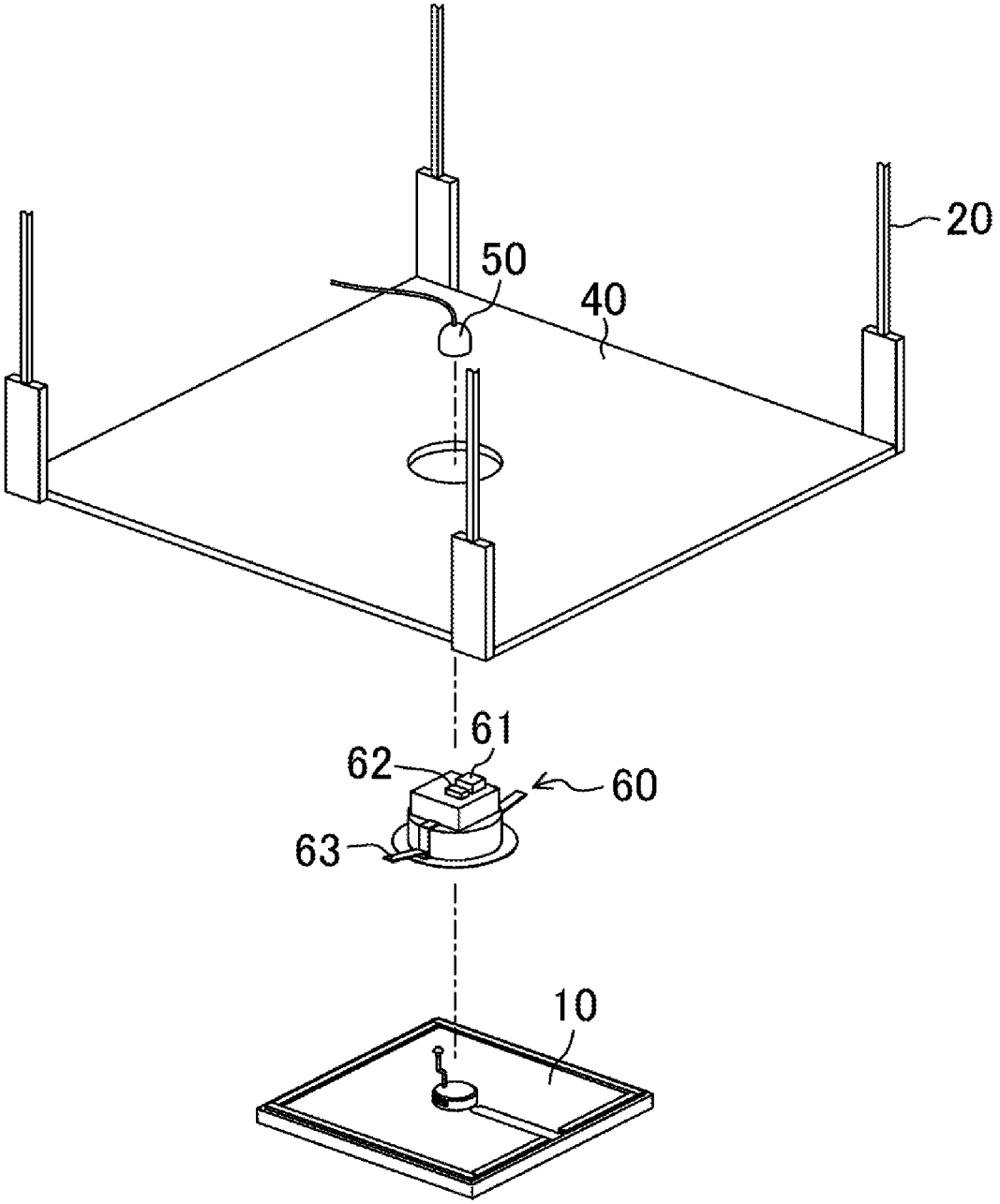
FIG. 10 is a figure for describing a method of mounting the lighting fixture according to a first embodiment.
Figure 11:
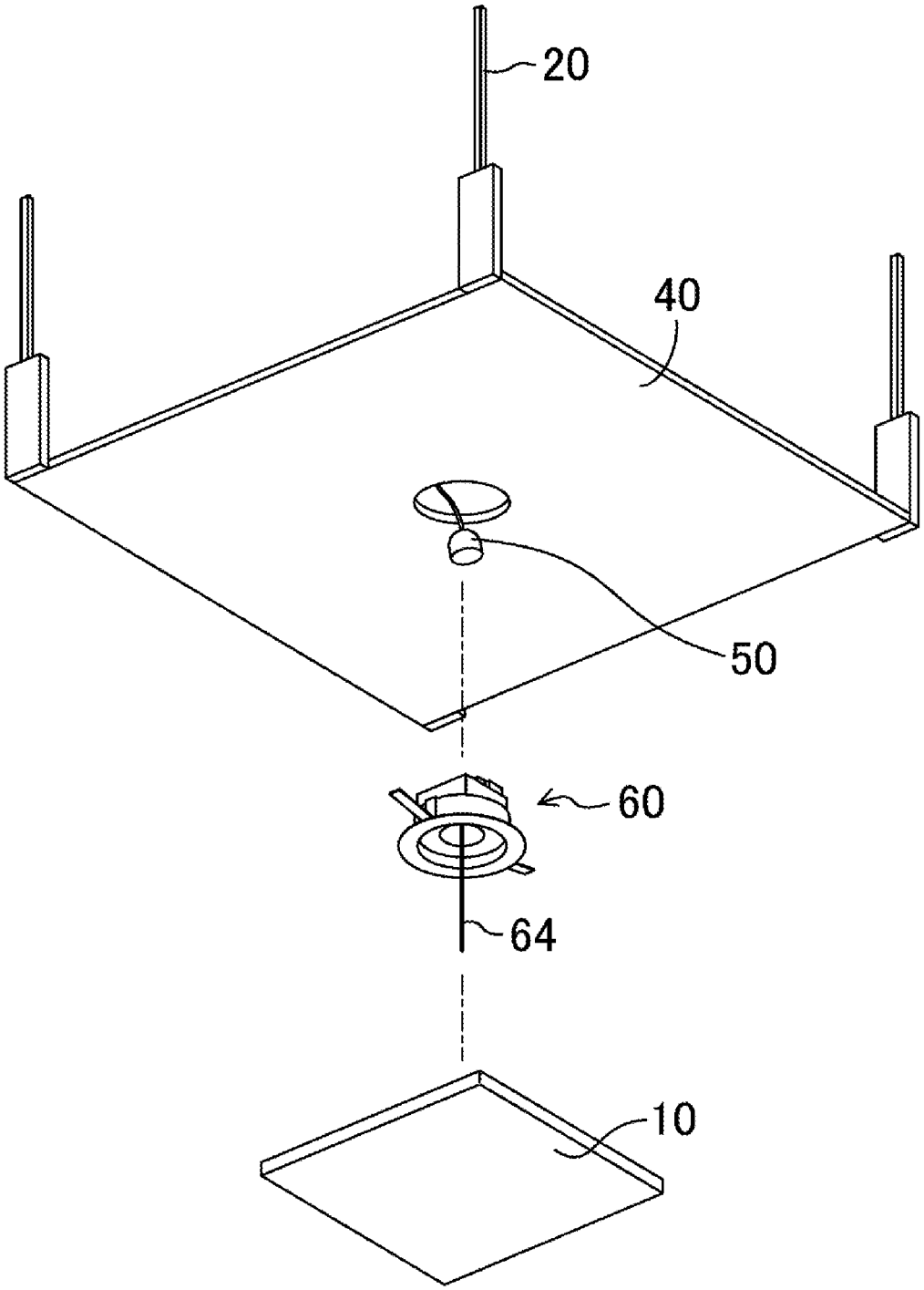
FIG. 11 is a figure for describing a method of mounting the lighting fixture according to a first embodiment.
Figure 12:
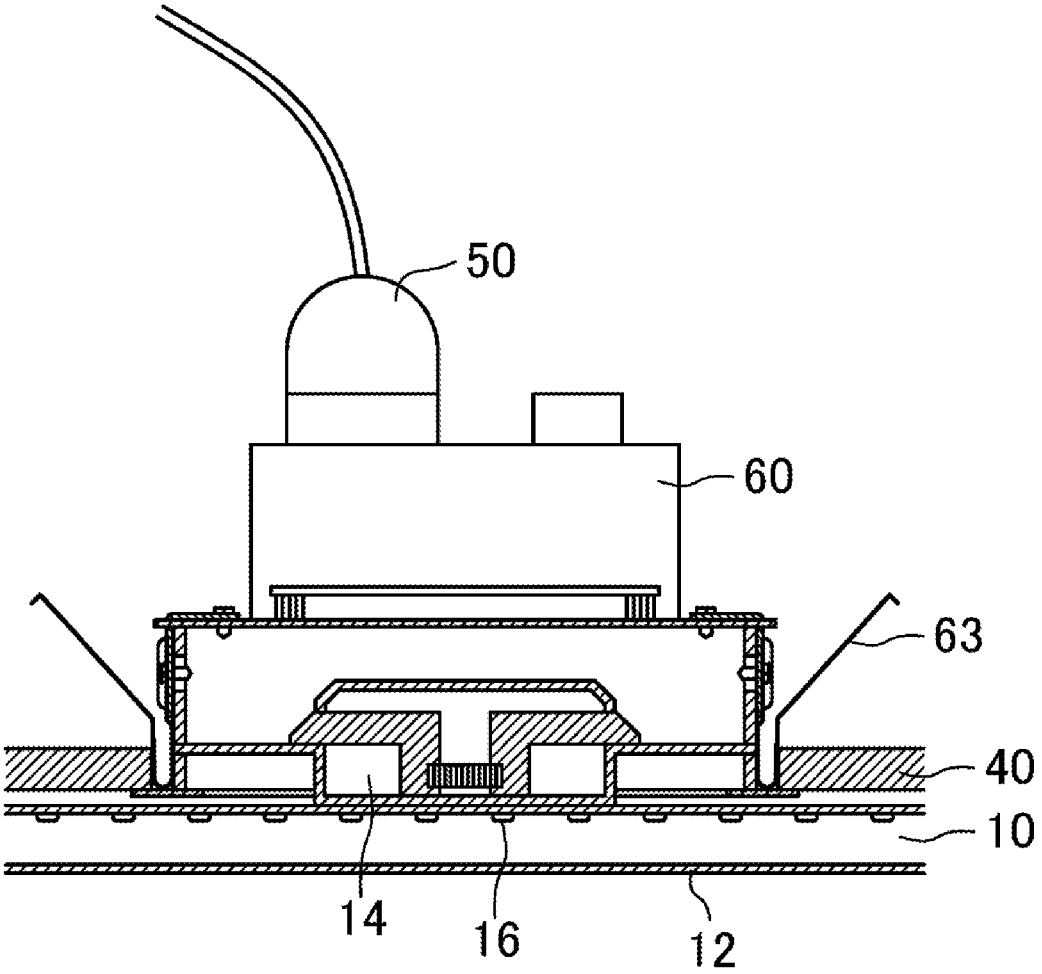
FIG. 12 shows the structure when the lighting fixture of the first embodiment is mounted to the ceiling.

Thus, the lighting installation work is performed in the equipment installation of step S6 after the ceiling 4 is provided. FIGS. 10 to 12 are drawings for describing the method of mounting the lighting fixture 10. FIG. 10 shows the structure when overlooking the connectional relationship of the ceiling material 40, the power supply adapter 60, and the lighting fixture 10 from the backward of the ceiling side, and FIG. 11 shows the form when overlooking structure the ceiling surface side (the lighting mounting surface side). Also, FIG. 12 shows the structure when the power supply adapter 60 and the lighting fixture 10 are connected and mounted to the ceiling material 40.

At the timing at which the ceiling 4 is provided in the building, the room space, which is the space forming the room shown in FIG. 2, and the ceiling backward space, which is the space of the backward of the ceiling shown in FIG. 9, are treated as differentiated spaces. Here, the existence or absence of openings of the ceiling material 40 is not considered. Specifically, when the ceiling 4 is formed of the ceiling materials 40 not having openings in the building 1, the ceiling backward space that is positioned above the ceiling 4 as one of all portions defining the space is differentiated from the room space that is positioned below the ceiling 4 as one of all portions defining the space.

First, a worker working at the room space prepares the lighting fixture 10 and the power supply adapter 60 inside the room space. The lighting fixture 10 is connected to the power supply adapter 60 by fitting the mounting adapter 14 of the lighting fixture 10 into the power supply adapter 60 by the worker working at the room space. Also, by being connected to the DC harness 64 of the power supply adapter 60, the lighting fixture 10 receives the electrical power supply of the DC power supply from the power supply adapter 60. For example, a direct current voltage of 100 V is supplied. The connection to the DC harness 64 also can be performed by a worker that does not have the qualification of a licensed electrician.

Because an AC power supply is supplied via the wiring 50, the power supply adapter 60 includes an AC/DC conversion function. Also, the power supply adapter 60 includes an AC terminal block 61 as a connection part for electrically connecting the connector-terminated wiring 50 via a connector. The worker working at the room space passes an arm through the opening, pulls the connector-terminated wiring 50 provided in the ceiling backward space from the opening, and pulls the connector-terminated wiring 50 into the room space. Then, the AC terminal block 61 and the connector of the connector-terminated wiring 50 are connected in the room space.

In preparation for in the case in which the lighting fixture 10 includes a dimming function of adjusting the intensity and/or color of the light emission, the power supply adapter 60 includes a dimming terminal block 62 as a connection part for connecting to a dimming driver device controlling the dimming. The dimming terminal block 62 is unnecessary in the case of employing a lighting fixture 10 that does not include a dimming function.

Also, the power supply adapter 60 includes a fastener 63, and the worker working at the room space mounts the power supply adapter 60 to the ceiling material 40 by using the fastener 63. The fastener 63 is springlike (elastic) and is passed through the opening of the ceiling material 40 from the ceiling surface side (the room space side). After passing through, the fastener 63 latches on the surface backward of the ceiling material 40; accordingly, the load is applied to the ceiling material 40. When the lighting fixture 10 is mounted to the ceiling 4, the load of one lighting fixture 10 and one power supply adapter 60 is applied to one ceiling material 40. The fastener 63 is not limited to a springlike structure, and it is sufficient for the structure to be such that the load is applied to the ceiling material 40.

The state in which the connector-terminated wiring 50 and the AC terminal block 61 of the power supply adapter 60 are connected, the mounting adapter 14 is fitted into the power supply adapter 60, and the lighting fixture 10 and the power supply adapter 60 are mounted to the ceiling material 40 is shown in FIG. 12.

Either the work of connecting the connector-terminated wiring 50 and the power supply adapter 60 or the work of connecting the power supply adapter 60 and the lighting fixture 10 can be performed first. Also, mounting the power supply adapter 60 to the ceiling material 40 can be performed before or after the lighting fixture 10 is connected to the power supply adapter 60.

As an example, a power supply adapter 60 that is mounted to a circular opening having a diameter of 150 mm includes a pass-through region that passes through the opening and is circular with a diameter of 148 mm excluding the fastener 63; the ceiling surface side of the power supply adapter 60 that contacts the ceiling surface is circular with a diameter of 160 mm. Also, the weight of the power supply adapter is 0.45 kg, and when combined with the weight of a lighting fixture 10 that is 450 mm×450 mm and has a height from the ceiling mounting surface to the light-emitting surface of 20 mm, the load that is applied to the ceiling material 40 is 2.39 kg.

Also, as another example, a power supply adapter 60 that is mounted to a circular opening having a diameter of 125 mm includes a pass-through region that passes through the opening and is circular with a diameter of 123 mm excluding the fastener 63; the ceiling surface side of the power supply adapter 60 that contacts the ceiling surface is circular with a diameter of 130 mm. Also, the weight of the power supply adapter is 0.37 kg, and when combined with the weight of a lighting fixture 10 that is 150 mm×600 mm and has a height from the ceiling mounting surface to the light-emitting surface of 20 mm, the load that is applied to the ceiling material 40 is 1.46 kg.

As one criterion, a ceiling-mounted appliance of which the load applied to the ceiling material 40 is less than 3.0 kg can be mounted to the ceiling without requiring fixation by the suspension member 20. For this aspect, any of the examples described above satisfy the power supply adapter 60 and the lighting fixture 10 being mounted to the ceiling material 40 and the total load being less than 3.0 kg.

Thus, because the installation work of the lighting fixture 10 does not include fixation by the suspension member 20, it is sufficient to provide an opening that is large enough to pull the connector-terminated wiring 50 from the backward of the ceiling into the room space. In other words, in the work of mounting the lighting fixture 10 to the ceiling 4, it is sufficient for the opening to have a size through which the arm can pass. On the other hand, for a lighting fixture for which the work of fixing with the suspension member 20 is necessary, it is difficult to mount the lighting fixture from the room space side by utilizing an opening large enough for only an arm to pass.

Also, by preparing the connector-terminated wiring 50 beforehand at the backward of the ceiling before the installation work of the lighting fixture 10, even a person who does not have the qualification of a licensed electrician can perform the work of electrically connecting the lighting fixture 10 and the wiring at the backward of the ceiling. Accordingly, the worker that makes a hole in the ceiling material 40 and mounts the ceiling material 40 as a portion of the ceiling can also perform the installation operation of the lighting fixture 10 as-is.

That is, in the construction of the building 1, instead of supplying the lighting fixture 10 to the electrical material trading company, the lighting fixture supplier can supply the lighting fixture 10 to the ceiling installer, and the ceiling installer can perform the ceiling work of the lighting fixture 10.

Figure 13:
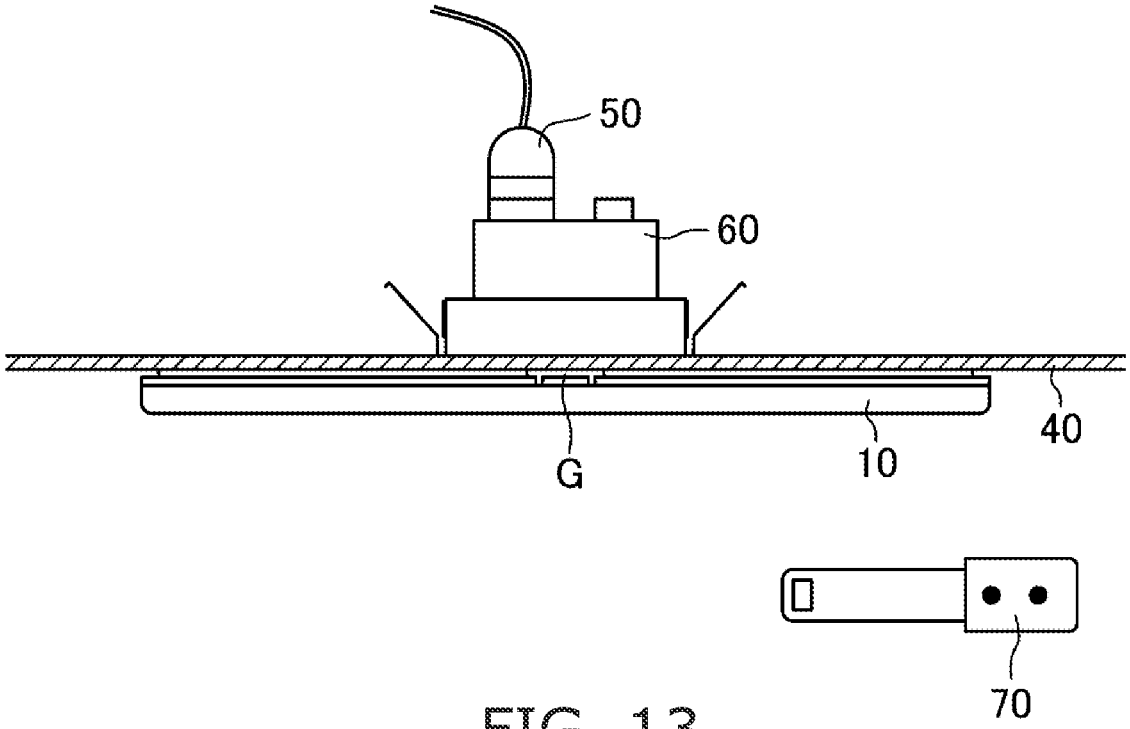
FIG. 13 is a figure for describing a method of removing the lighting fixture of the first embodiment from the ceiling.

As shown in FIG. 13, a detachment arm 70 is used when detaching the lighting mixture 10 mounted to the ceiling 4. Even in the state in which the lighting fixture 10 is mounted to the ceiling 4 and the ceiling surface and the cushioning part 13 of the lighting fixture 10 are in contact, the portion where the cushioning part 13 is not provided is used as the detachment arm insertion slot G through which the detachment arm 70 can be inserted. The lighting fixture 10 can be detached using the detachment arm 70 inserted into the detachment arm insertion slot G.

Second Embodiment

Construction processes of a building according to a second embodiment will now be described. Other than the mounting process of a lighting fixture 210 of step S6, the construction processes of the building 1 according to the second embodiment are similar to the construction processes of the building 1 according to the first embodiment.

Figure 14:
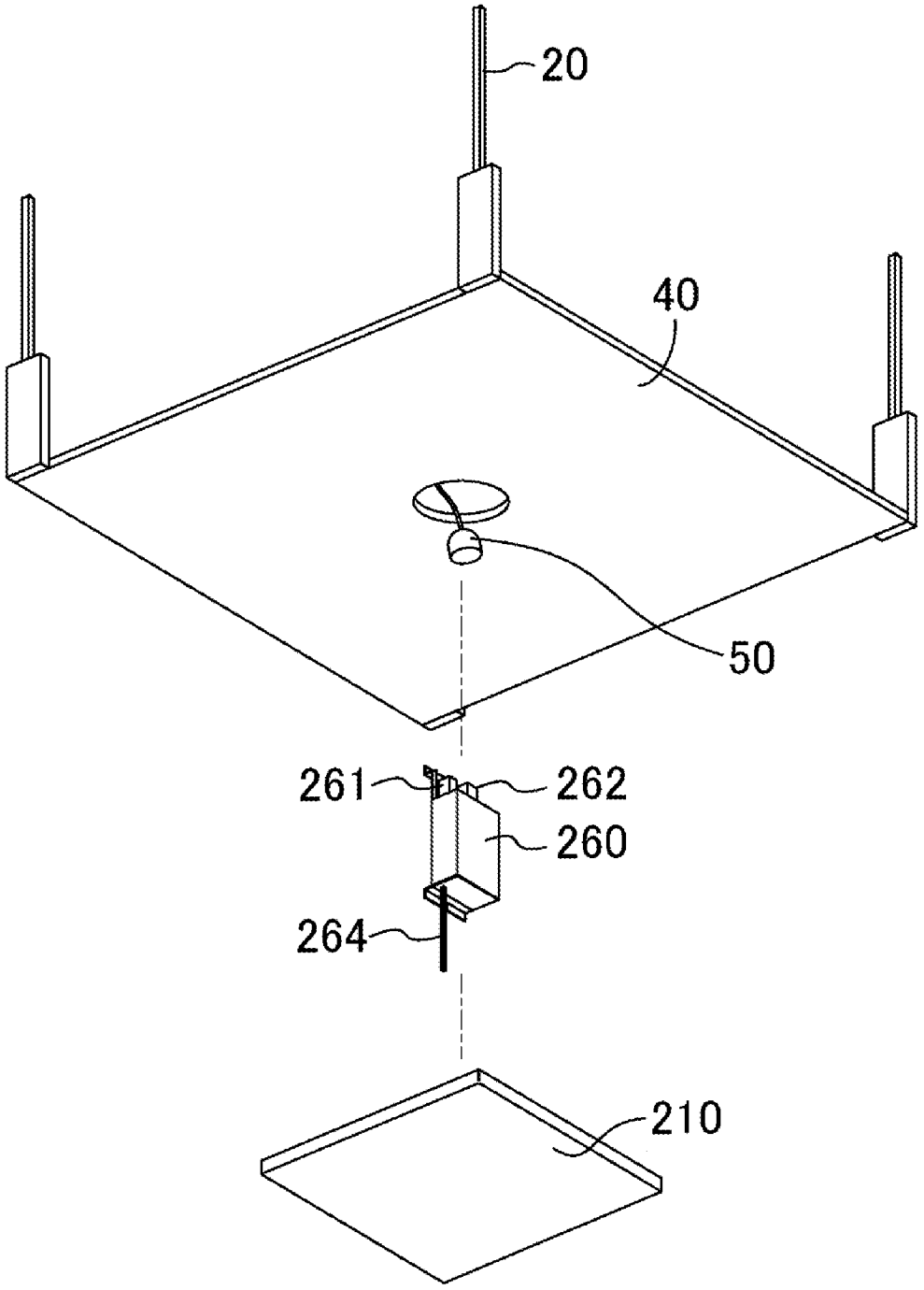
FIG. 14 is a figure for describing a method of mounting the lighting fixture according to a second embodiment.
Figure 15:
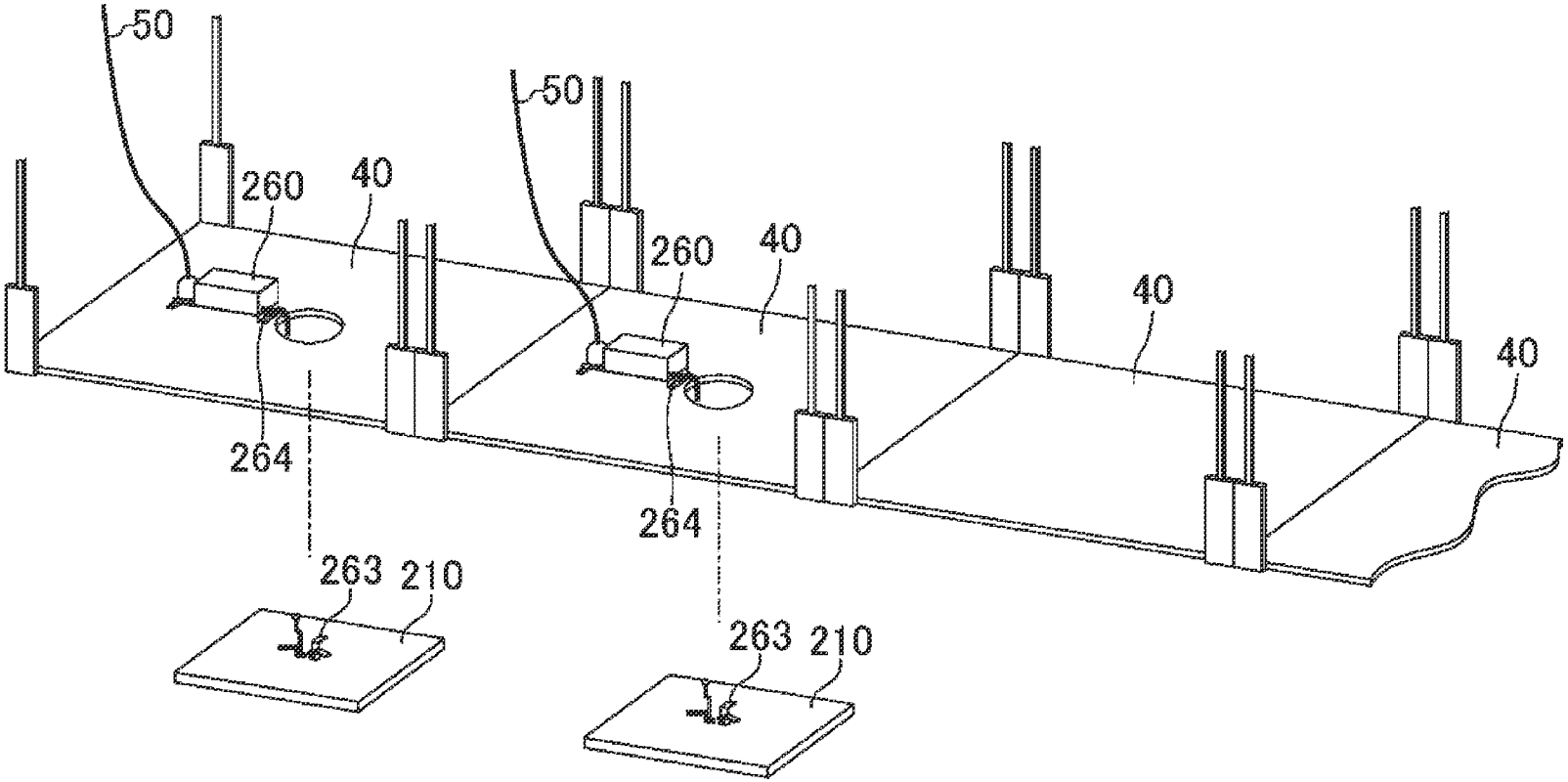
FIG. 15 is a figure for describing a method of mounting the lighting fixture according to the second embodiment.

FIGS. 14 and 15 are drawings for describing the method of mounting the lighting fixture 210. FIG. 14 shows the structure when overlooking the connectional relationship of the ceiling material 40, a power supply adapter 260, and the lighting fixture 210 from the ceiling backward side, and FIG. 15 shows the structure when overlooking from the ceiling surface side (the lighting mounting surface side). Also, FIG. 15 shows the state in which the power supply adapter 60 and the connector-terminated wiring 50 are connected.

In the installation work of the lighting fixture 10 according to the first embodiment, the fastener 63 of the power supply adapter 60 is mounted to the opening of the ceiling material 40, but the installation work of the lighting fixture 210 of the second embodiment differs in that the power supply adapter 260 is located at the backward of the ceiling, and a fastener 263 of the lighting fixture 210 is mounted to the opening of the ceiling material 40.

At the start timing of the installation work of the lighting fixture 210, the power supply adapter 260 is not located at the backward of the ceiling as shown in FIG. 14. Accordingly, the worker working at the room space passes an arm through the opening, pulls the connector-terminated wiring 50 provided in the ceiling backward space from the opening, and pulls the connector-terminated wiring 50 into the room space. Then, the connector of the connector-terminated wiring 50 and an AC terminal block 261 of the power supply adapter 260 are connected in the room space.

The worker working at the room space places the power supply adapter 260 connected to the connector-terminated wiring 50 via the opening through which the connected connector-terminated wiring 50 was passed. The connector-terminated wiring 50 also is returned to the backward of the ceiling, and a DC harness 264 of the power supply adapter 260 protrudes into the room space through the opening. The lighting fixture 210 is connected to the DC harness 264 and receives the supply of the power supply. Also, the lighting fixture 210 includes the fastener 263 instead of the mounting adapter 14, and is mounted to the ceiling 4 by the fastener 263 being passed through the opening and latching on the backward of the ceiling of the ceiling material 40.

The power supply adapter 260 is placed at the backward of the ceiling of the ceiling material 40 at the vicinity of the opening of the ceiling material 40 through which the power supply adapter 260 passed. Accordingly, when one lighting fixture 210 is mounted to one ceiling material 40, the one power supply adapter 260 connected to the lighting fixture 210 is placed at the one ceiling material 40. Accordingly, it is unchanged from the first embodiment that the load of one power supply adapter 260 and one lighting fixture 210 is applied to one ceiling material 40.

The power supply adapter 260 can be located at a ceiling material 40 to which the lighting fixture 210 is not mounted. In the example of FIG. 15, the power supply adapter 260 can be moved to be located at a ceiling material 40 that does not have any opening. The load that is applied to one ceiling material 40 can be reduced thereby. For example, in FIG. 15, a total of two power supply adapters 260 that are located respectively at two ceiling materials 40 can be placed at one ceiling material that does not have any opening. However, it also can be considered that the work of arranging the power supply adapter 260 is difficult or troublesome if the distance to the ceiling material 40 is large to the extent that the arm does not reach the ceiling material 40 even when outstretched.

Thus, compared to the first embodiment, in the second embodiment, the power supply adapter 260 is located at the backward of the ceiling; the lighting fixture 210 is mounted to the opening of the ceiling material 40; thereby, the load that is applied to the ceiling material 40 is reduced by virtue of the fastener 263. In the first embodiment, the fastener 63 supports the weight of the power supply adapter 60 and the weight of the lighting fixture 10, but in the second embodiment, the fastener 263 support only the weight of the lighting fixture 210, and does not need to support the weight of the power supply adapter 260.

Hereinabove, a building, a method of constructing the building, a method of mounting a lighting fixture of the building constructed, etc., according to the invention are described based on the embodiments, but the technical idea of the invention is not limited to the specific embodiments described above. Although examples are described in the embodiments in which the lighting fixture according to the invention is mounted in an room, the mounting location is not limited to an room and can be, for example, a location such as a main entrance or a hall. The room space is not limited to an room, and can refer to a space opposite side to the backward of the ceiling with the ceiling as the boundary.

Also, the invention is applicable without requiring that all components discussed by the embodiments are sufficiently included. Within the scope of the degrees of freedom of design by one skilled in the art or in the technical field of the invention, the invention is applicable even when a portion of the components discussed by the embodiments is not recited in the claims; the present specification discloses the invention on the premise that such portions are included.

INDUSTRIAL APPLICABILITY

A building or a lighting fixture according to the embodiments can be used in the field of construction of office buildings, high-rise buildings, etc.

The invention claimed is:

1. A method of mounting a large lightweight lighting fixture, the method comprising:

preparing connector-terminated wiring in a space above a ceiling, the connector-terminated wiring being electrically connectable to the lighting fixture, the ceiling comprising a ceiling material, the lighting fixture being a lighting fixture that is not fixed by a suspension member when being mounted to the ceiling;

connecting the connector-terminated wiring and a power supply adapter by using a connector of the connector-terminated wiring via an opening provided in the ceiling material;

electrically connecting the lighting fixture and the power supply adapter while the lighting fixture is located in a room space below the ceiling; and mounting the lighting fixture to the ceiling material by passing a fastener through the opening of the ceiling material, wherein the fastener is included in (i) the lighting fixture that is electrically connected to the connector-terminated wiring, or (ii) the power supply adapter that is electrically connected to the connector-terminated wiring, wherein:

the step of preparing the connector-terminated wiring is performed by a first worker, and the steps of connecting the connector-terminated wiring and the power supply, electrically connecting the lighting fixture and the power supply adapter, and mounting the lighting fixture to the ceiling material are performed by a second worker that is different from the first worker.

2. The method according to claim 1, wherein:

the lighting fixture includes a cushioning part at a rim on a mounting surface side of the ceiling, and the mounting of the lighting fixture to the ceiling material includes mounting the lighting fixture to the ceiling material by causing the cushioning part and a ceiling surface of the ceiling material to be in contact with each other.

3. The method according to claim 2, wherein:

the mounting is realized by using the lighting fixture that includes a region where the cushioning part is not provided at a portion of the rim, and that is detachable from the ceiling material by utilizing the region where the cushioning part is not provided.

4. The method according to claim 1, wherein:

the connecting of the connector-terminated wiring and the power supply adapter by using the connector of the connector-terminated wiring includes connecting the connector-terminated wiring and the power supply adapter by using the connector of the connector-terminated wiring after the lighting fixture and the power supply adapter are electrically connected by the electrical connection of the lighting fixture and the power supply adapter.

5. The method according to claim 1, wherein:

the connecting of the connector-terminated wiring and the power supply adapter by using the connector of the connector-terminated wiring includes electrically connecting the connector-terminated wiring and the power supply adapter by using the connector of the connector-terminated wiring before the lighting fixture and the power supply adapter are electrically connected by the electrical connection of the lighting fixture and the power supply adapter.

6. The method according to claim 1, wherein:

the mounting of the lighting fixture to the ceiling material includes mounting the lighting fixture electrically connected to the power supply adapter by the electrical connection of the lighting fixture and the power supply adapter after the power supply adapter is mounted to the ceiling material by passing the fastener included in the power supply adapter through the opening of the ceiling material.

7. The method according to claim 1, wherein:

the mounting of the lighting fixture to the ceiling material includes mounting the lighting fixture to the ceiling material by passing, through the opening of the ceiling material, the fastener included in the power supply adapter that is electrically connected to the lighting fixture by the electrical connection of the lighting fixture and the power supply adapter.

8. The method according to claim 1, wherein:

the connecting of the connector-terminated wiring and the power supply adapter by using the connector of the connector-terminated wiring is performed by the second worker working in the room space.

9. The method according to claim 1, wherein:

the connecting of the connector-terminated wiring and the power supply adapter by using the connector of the connector-terminated wiring includes pulling the connector of the connector-terminated wiring into the room space and connecting the connector and the power supply adapter in the room space.

10. The method according to claim 1, wherein:

the mounting of the lighting fixture to the ceiling material includes mounting the lighting fixture so that a load of the lighting fixture is applied to the ceiling material to which the lighting fixture is mounted.

11. The method according to claim 1, wherein:

a maximum diameter of the opening is 15 cm or less.

12. The method according to claim 1, wherein:

the lighting fixture includes a base plate forming a mounting surface, and a mounting adapter located on the mounting surface, and the electrical connection of the lighting fixture and the power supply adapter includes connecting the base plate, the lighting fixture, and the power supply adapter by using the mounting adapter.

13. The method according to claim 1, wherein:

the first worker is a licensed electrician, and the second worker is not a licensed electrician.

14. A method of mounting a large lightweight lighting fixture, the method comprising:

providing the lighting fixture, which has a total luminous flux of 2500 lm or more and has a light-emitting surface with a surface area of 45000 $mm^2$ or more;

preparing connector-terminated wiring in a space above a ceiling, the connector-terminated wiring being electrically connectable to the lighting fixture, the ceiling comprising a ceiling material, the lighting fixture being a lighting fixture that is not fixed by a suspension member when being mounted to the ceiling;

connecting the connector-terminated wiring and a power supply adapter by using a connector of the connector-terminated wiring, and placing the power supply adapter that is electrically connected to the connector-terminated wiring in a the space above the ceiling;

electrically connecting the lighting fixture and the power supply adapter; and mounting the lighting fixture to the ceiling material by passing a fastener through an opening of the ceiling material, the fastener being included in the lighting fixture that is electrically connected to the connector-terminated wiring, the opening of the ceiling material being not more than ⅓ of the surface area of the light-emitting surface of the lighting fixture.

15. The method according to claim 14, wherein:

the lighting fixture includes a cushioning part at a rim on a mounting surface side of the ceiling, and the mounting of the lighting fixture to the ceiling material includes mounting the lighting fixture to the ceiling material by causing the cushioning part and a ceiling surface of the ceiling material to be in contact with each other.

16. The method according to claim 15, wherein:

the mounting is realized by using the lighting fixture that includes a region where the cushioning part is not provided at a portion of the rim, and that is detachable from the ceiling material by utilizing the region where the cushioning part is not provided.

17. The method according to claim 14, wherein:

the step of preparing the connector-terminated wiring is performed by a first worker, and the steps of connecting the connector-terminated wiring and the power supply, electrically connecting the lighting fixture and the power supply adapter, and mounting the lighting fixture to the ceiling material are performed by a second worker that is different from the first worker.

18. The method according to claim 17, wherein:

the first worker is a licensed electrician, and the second worker is not a licensed electrician.

19. The method according to claim 14, wherein:

the mounting of the lighting fixture to the ceiling material includes mounting the lighting fixture to the ceiling material by passing, through the opening of the ceiling material, the fastener included in the lighting fixture electrically connected to a power supply adapter by the electrical connection of the lighting fixture and the power supply adapter.

20. The method according to claim 14, wherein:

the connecting of the connector-terminated wiring and the power supply adapter by using the connector of the connector-terminated wiring includes connecting the connector-terminated wiring and the power supply adapter by using the connector of the connector-terminated wiring after the lighting fixture and the power supply adapter are electrically connected by the electrical connection of the lighting fixture and the power supply adapter.

21. The method according to claim 14, wherein:

the connecting of the connector-terminated wiring and the power supply adapter by using the connector of the connector-terminated wiring includes electrically connecting the connector-terminated wiring and the power supply adapter by using the connector of the connector-terminated wiring before the lighting fixture and the power supply adapter are electrically connected by the electrical connection of the lighting fixture and the power supply adapter.

22. The method according to claim 14, wherein:

the connecting of the connector-terminated wiring and the power supply adapter by using the connector of the connector-terminated wiring is performed by a worker working in the room space.

23. The method according to claim 14, wherein:

the connecting of the connector-terminated wiring and the power supply adapter by using the connector of the connector-terminated wiring includes pulling the connector of the connector-terminated wiring into the room space and connecting the connector and the power supply adapter in the room space.

24. The method according to claim 14, wherein:

the mounting of the lighting fixture to the ceiling material includes mounting the lighting fixture so that a load of the lighting fixture is applied to the ceiling material to which the lighting fixture is mounted.

25. The method according to claim 14, wherein:

a maximum diameter of the opening is 15 cm or less.

* * * * *